US010041272B2

(12) United States Patent
Choi

(10) Patent No.: US 10,041,272 B2
(45) Date of Patent: Aug. 7, 2018

(54) HIGH-CEILING TENT FRAME

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 252 days.

(21) Appl. No.: 14/753,989

(22) Filed: Jun. 29, 2015

(65) Prior Publication Data

US 2015/0376913 A1 Dec. 31, 2015

(30) Foreign Application Priority Data

Jun. 27, 2014 (CN) ..... 2014 2 0349197 U
Sep. 28, 2014 (CN) ..... 2014 1 0506395
Sep. 28, 2014 (CN) ..... 2014 2 0562771 U
Nov. 5, 2014 (CN) ..... 2014 1 0615273

(51) Int. Cl.
*E04H 15/50* (2006.01)

(52) U.S. Cl.
CPC ..... *E04H 15/50* (2013.01)

(58) Field of Classification Search
CPC ..... E04H 15/48; E04H 15/50; E04H 15/52; E04H 15/58
USPC ..... 135/117, 143–147, 159
See application file for complete search history.

(56) References Cited

U.S. PATENT DOCUMENTS 1,061,547 A 5/1913 Kennedy
1,347,107 A 7/1920 McCann
3,888,056 A 6/1975 Kelly
4,944,321 A 7/1990 Moyet-Ortiz
5,275,188 A 1/1994 Tsai
5,794,640 A 8/1998 Jang
5,813,425 A * 9/1998 Carter ..... E04H 15/50 135/145
6,182,917 B1 2/2001 Lai
6,463,948 B2 10/2002 Lee
(Continued)

FOREIGN PATENT DOCUMENTS

CA 2895981 A1 * 12/2015 ..... E04H 15/50
CN 2401649 Y 10/2000
(Continued)

OTHER PUBLICATIONS

U.S. Appl. No. 15/170,566, filed Jun. 1, 2016.
(Continued)

*Primary Examiner* — Robert Canfield
(74) *Attorney, Agent, or Firm* — Morgan, Lewis & Bockius LLP

(57) ABSTRACT

A high-ceiling tent frame includes one or more frame units. Each frame unit includes three or more vertical poles and a center pole connected by supporting pole groups. Each frame unit also includes vertical pole fixed and slidable connecting bases installed at the vertical poles, and center fixed and slidable connecting bases installed at the center pole. Each supporting top pole group includes one or more first connecting pole units pivotally connected to each other. Each first connecting pole unit includes two first connecting poles pivotally connected to each other and forms an X-shape when the tent frame is unfolded. Adjacent frame units are connected to each other by sharing at least two vertical poles.

15 Claims, 19 Drawing Sheets

(56) References Cited

U.S. PATENT DOCUMENTS

| | | | | |
|---|---|---|---|---|
| 6,598,614 | B2 | 7/2003 | Liu | |
| 6,708,707 | B2 | 3/2004 | Dotterweich | |
| 6,848,461 | B2 | 2/2005 | Tsai | |
| 6,929,017 | B2 * | 8/2005 | Byun | E04H 15/50 135/131 |
| 7,240,686 | B2 | 7/2007 | Seo | |
| 7,299,813 | B2 * | 11/2007 | Ochi | E04H 15/50 135/131 |
| 7,316,239 | B2 | 1/2008 | Yang | |
| 7,360,549 | B2 | 4/2008 | Seo | |
| 7,422,026 | B2 | 9/2008 | Kim | |
| 8,220,477 | B2 | 7/2012 | Park | |
| D705,884 | S | 5/2014 | Jin | |
| 8,893,737 | B2 | 11/2014 | Yang | |
| 8,910,648 | B2 | 12/2014 | Jin | |
| 9,528,292 | B1 | 12/2016 | Lovley, II | |
| 9,739,073 | B2 | 8/2017 | Huang | |
| 2001/0050098 | A1 | 12/2001 | Lee | |
| 2002/0074032 | A1 | 6/2002 | Park | |
| 2005/0241688 | A1 | 11/2005 | Wu | |
| 2006/0169312 | A1 | 8/2006 | Choi | |
| 2007/0012347 | A1 * | 1/2007 | Ochi | E04H 15/50 135/145 |
| 2007/0051397 | A1 | 3/2007 | Choi | |
| 2007/0144572 | A1 * | 6/2007 | Patel | E04H 15/50 135/131 |
| 2007/0221262 | A1 | 9/2007 | Tsai | |
| 2009/0032079 | A1 | 2/2009 | Choi | |
| 2010/0043856 | A1 | 2/2010 | Park | |
| 2011/0073148 | A1 | 3/2011 | Choi | |
| 2013/0014794 | A1 | 1/2013 | Jin | |
| 2013/0247948 | A1 | 9/2013 | Lovely et al. | |
| 2013/0284225 | A1 | 10/2013 | Holland | |
| 2014/0174491 | A1 | 6/2014 | Yang | |
| 2014/0261601 | A1 | 9/2014 | Jin | |
| 2014/0290710 | A1 | 10/2014 | Choi | |
| 2015/0083177 | A1 | 3/2015 | Hotes | |
| 2015/0247339 | A1 * | 9/2015 | Lee | E04H 15/50 135/145 |
| 2015/0308147 | A1 * | 10/2015 | Lee | E04H 1/1205 135/145 |
| 2015/0376913 | A1 | 12/2015 | Choi | |
| 2016/0108639 | A1 * | 4/2016 | Huang | E04H 15/322 135/144 |
| 2016/0348392 | A1 | 12/2016 | Jin | |
| 2017/0121999 | A1 | 5/2017 | Ma | |
| 2017/0292287 | A1 * | 10/2017 | Lovley, II | E04H 15/50 |

FOREIGN PATENT DOCUMENTS

| | | | | | |
|---|---|---|---|---|---|
| CN | 201202302 | Y | | 3/2009 | |
| CN | 103590650 | B | | 2/2014 | |
| CN | 104265063 | A | * | 1/2015 | |
| CN | 104358468 | A | * | 2/2015 | |
| CN | 204163467 | U | | 2/2015 | |
| FR | 1 121 851 | | | 8/1956 | |
| FR | 68588 | | | 5/1958 | |
| JP | 4557885 | B2 | * | 10/2010 | E04H 15/50 |
| WO | WO 2010104939 | A1 | | 9/2010 | |
| WO | WO 2011/022764 | A1 | | 3/2011 | |
| WO | WO 2013/116545 | A1 | | 8/2013 | |

OTHER PUBLICATIONS

U.S. Appl. No. 15/170,587, filed Jun. 1, 2016.
Design U.S. Appl. No. 29/600,927, filed Apr. 17, 2017.
Design U.S. Appl. No. 29/600,929, filed Apr. 17, 2017.
U.S. Appl. No. 15/709,222, filed Sep. 19, 2017.
U.S. Appl. No. 15/709,234, filed Sep. 19, 2017.
U.S. Appl. No. 15/782,699, filed Oct. 13, 2017.
U.S. Appl. No. 15/782,717, filed Oct. 12, 2017.
U.S. Appl. No. 15/782,726, filed Oct. 12, 2017.
U.S. Appl. No. 15/7821,019, filed Nov. 22, 2017.

* cited by examiner

HIGH-CEILING TENT FRAME

CROSS-REFERENCE TO RELATED APPLICATION

The present application claims priority of Chinese Utility Model Application Numbers CN 201420349197.5 filed Jun. 27, 2014 and CN 201420562771.5 filed Sep. 28, 2014, and Chinese Patent Application Numbers CN 201410506395.2 filed Sep. 28, 2014 and CN 201410615273.7 filed Nov. 5, 2014, the entire contents of which applications are incorporated herein for all purposes by this reference.

FIELD OF INVENTION

The present invention relates to an outdoor product, in particular, to a high-ceiling tent frame.

DESCRIPTION OF RELATED ART

As an outdoor leisure product, tents are widely used in various occasions. A common tent frame is formed by connecting a plurality of groups of vertical poles to top poles, wherein the top poles form a top support. The tents applying such frames have common drawbacks in that the structures thereof are generally more complex, a plurality of groups of poles are needed to support tent fabrics, the frames are difficult and time-consuming to establish and the manufacturing costs are increased.

Chinese invention patent ZL201310429420.7 discloses a foldable tent eave frame structure, which comprises a tent frame and an eave pole. The tent frame comprises vertical posts, tent poles and oblique supporting poles. Fixed bases are fixedly arranged at top ends of the vertical posts. Slidable bases, which can slide up and down along the vertical posts, are slidably connected onto the vertical posts. First ends of the tent poles are pivoted onto the fixed bases. First ends of the oblique supporting poles are pivoted onto the slidable bases and second ends of the oblique supporting poles are pivoted onto the tent poles. The slidable bases slide up and down along the vertical posts to fold or unfold the tent frame. The tent frame is provided with a sliding way. A first end of the eave pole is pivoted onto the oblique supporting poles. The eave pole can move relative to the sliding way to enable a second end of the eave pole to get far away from or close to the sliding way to realize the unfolding or folding of the eave pole. The unfolding or folding of the tent frame induces the unfolding or folding of the eave pole.

However, poles, which mainly play a role of folding, of the conventional tents are centralized between two vertical posts. Thus, the height of an entrance/exit of the tent is inherently reduced, causing inconvenience to users. In addition, since scissors-shaped connecting pole groups of the tent are arranged on the periphery of the tent and there are no similar poles inside, items cannot be hung inside.

Although one eave pole is added to the tent and applied to support the tent fabric, a probability that water is accumulated between the vertical poles and the center base on rainy days still exists. The problem of water accumulation on rainy days cannot be fully solved.

Given the above background, there is a need in the art for a tent frame that provides adequate space with a stable structure, capability of hanging items inside, and/or capability of preventing water from accumulating on rainy days.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

In various aspects, the present invention provides a high-ceiling tent frame with a stable structure, capability of hanging items inside and/or capability of preventing water from accumulating on rainy days.

In some aspects, a high-ceiling tent frame of the present invention comprises one or more frame units. Each frame unit comprises: three or more vertical poles; a center pole; a plurality of supporting pole groups for connecting the center pole with the vertical poles; vertical pole fixed connecting bases installed at top ends of the vertical poles; vertical pole slidable connecting bases installed on pole bodies of the vertical poles and slidable along the pole bodies of the vertical poles; a center fixed connecting base installed at a bottom end of the center pole; and a center slidable connecting base installed on a pole body of the center pole and slidable along the pole body of the center pole, wherein: each supporting top pole group comprises one or more first connecting pole units; the one or more first connecting pole units are pivotally connected to each other; each first connecting pole unit comprises two first connecting poles pivotally connected to each other and forms an X-shape when the tent frame is unfolded; and in each supporting top pole group, the first connecting pole unit adjacent the center pole has one of the two first connecting poles pivotally connected to the center slidable connecting base and the other one of the two first connecting poles pivotally connected to the center fixed connecting base, and the first connecting pole unit adjacent a corresponding vertical pole has one of the two first connecting poles pivotally connected to the vertical pole slidable connecting base and the other one of the two first connecting poles pivotally connected to the vertical pole fixed connecting base of the corresponding vertical pole.

In one aspect, the high-ceiling tent frame further comprises: side top pole groups each configured to connect two adjacent vertical poles; and oblique supporting poles each configured to connect a side top pole group to a corresponding vertical pole. Each side top pole group comprises two side top poles pivotally connected to each other and forms a substantially straight line when the tent frame is unfolded; one end of each side top pole is pivotally connected to the vertical pole fixed connecting base of a corresponding vertical pole in the two adjacent vertical poles; one end of each oblique supporting pole is pivotally connected to the vertical pole slidable connecting base of the corresponding vertical pole; and the other end of each oblique supporting pole is pivotally connected to the side top pole that is connected to the same corresponding vertical pole.

In some aspects, within a respective frame unit: the three or more vertical poles comprises four vertical poles that form two vertical pole groups, wherein each vertical pole group comprises two adjacent vertical poles; the two adjacent vertical poles in each vertical pole group are connected by a side top pole group; the side top pole group comprises one or more second connecting pole units; the one or more second connecting pole units are pivotally connected to each other; each second connecting pole unit comprises two second connecting poles pivotally connected to each other and forms an X-shape when the tent frame is unfolded; one of the second connecting poles of each second connecting pole unit adjacent the corresponding vertical pole is pivotally connected to the vertical pole slidable connecting base of the corresponding vertical pole; and the other one of the second connecting poles of each second connecting pole unit adjacent the corresponding vertical pole is pivotally connected to the vertical pole fixed connecting base of the corresponding vertical pole.

In one aspect, the high-ceiling tent frame further comprises an inner horizontal pole group for connecting two of the supporting top pole groups that are connected to different vertical pole groups within the respective frame unit. The inner horizontal pole group comprises one of the following: (i) two short poles, one ends thereof are pivotally connected to each other, and the other ends thereof are pivotally connected to the first connecting pole units of the supporting top pole groups at hinging points adjacent to the center pole; (ii) two short poles, one ends thereof are pivotally connected to each other, and the other ends are pivotally connected to the first connecting pole units of the corresponding supporting top pole group at upper hinging points of the first connecting pole units; (iii) two short poles, one ends thereof are pivotally connected to each other, and the other ends are pivotally connected to the first connecting pole units of the corresponding supporting top pole group at the upper hinging points of the first connecting pole units, wherein each short pole is supported by an oblique supporting pole, wherein one end of the oblique supporting pole is pivotally connected to a pole body of the corresponding short pole and the other end is pivotally connected to a lower hinging point of a corresponding first connecting pole unit; or (iv) one or more third connecting pole units, wherein the one or more third connecting pole units are pivotally connected to each other, each third connecting pole unit comprises two third connecting poles pivotally connected to each other and forms an X-shape when the tent frame is unfolded, one of the third connecting poles of each third connecting pole unit adjacent the corresponding supporting top pole group is pivotally connected to a first connecting pole unit of the corresponding supporting top pole group at the upper hinging point of the first connecting pole unit and the other one of the third connecting poles of each third connecting pole unit adjacent the corresponding supporting top pole group is pivotally connected to the first connecting pole unit of the corresponding supporting top pole group at the lower hinging point of the first connecting pole unit.

In another aspect, the high-ceiling tent frame further comprises an inner horizontal pole group for connecting two adjacent vertical poles in the two vertical pole groups within the respective frame unit. The inner horizontal pole group comprises two short poles, one ends thereof are pivotally connected to each other, and the other ends are pivotally connected to the vertical pole fixed connecting bases of the corresponding vertical poles; and each short pole is supported by an oblique supporting pole, wherein one end of the oblique supporting pole is pivotally connected to a pole body of the corresponding short pole and the other end is pivotally connected to the vertical pole slidable connecting base of a corresponding vertical pole.

In an aspect, the high-ceiling tent frame further comprises a connecting pin and a spring disposed between the center pole and the center fixed connecting base. A first elongated slot or a first pin hole is formed at a bottom end portion of the center pole; the center fixed connecting base includes: (i) a connecting pole hinging part for receiving the first connecting poles, (ii) a blind hole for receiving the center pole, (iii) a second pin hole corresponding to the first elongated slot of the center pole and formed adjacent to a mouth part of the blind hole, or a second elongated slot corresponding to the first pin hole of the center pole and formed on a side wall of the blind hole; the connecting pin penetrates through the corresponding elongated slot and the corresponding pin hole, connecting the center pole with the center fixed connecting base; and the spring is placed in the blind hole, one end of the spring presses against a bottom end of the center pole and the other end presses against a bottom part of the blind hole.

In some aspects, the high-ceiling tent frame further comprises supporting pieces installed on the first connecting poles that are connected to the vertical pole fixed connecting bases. Each supporting piece comprises: a connecting part fixedly connected to a corresponding first connecting pole; and a horizontal pole for supporting a tent fabric, wherein the horizontal pole and the connecting part are fixedly connected to each other at a predetermined angle.

In some aspects, the high-ceiling tent frame further comprises one or more water accumulation preventing pole groups. A water accumulation preventing pole group is connected to a corresponding first connecting pole unit and comprises: a slidable connecting piece pivotally connected to one connecting pole of the corresponding first connecting pole unit; and a fabric supporting pole, a pole body thereof is slidably connected to the slidable connecting piece and one end thereof is pivotally connected to the other connecting pole of the corresponding first connecting pole unit, such that the fabric supporting pole is disposed substantially vertically and upwardly when the tent frame is unfolded.

In an aspect, the slidable connecting piece is pivotally connected to the one connecting pole of the corresponding first connecting pole unit by a bracket, wherein the bracket is pivotally connected to the slidable connecting piece and fixedly connected to the one connecting pole of the corresponding first connecting pole unit.

In some aspects, the high-ceiling tent frame further comprises one or more water accumulation preventing pole groups. A water accumulation preventing pole group comprising: an eave supporting pole; an eave moving pole, one end thereof is pivotally connected to one end of the eave supporting pole, and the other end or a pole body of the eave moving pole is pivotally connected to the third or fourth one of the first connecting poles; and a connecting part, one end thereof is pivotally connected to the pole body of the eave pole and the other end thereof is pivotally connected to the fourth one of the first connecting poles.

In an aspect, the eave moving pole comprises: a first pole; a second pole, one end thereof is rotatably connected to one end of the first pole; and a stop block disposed at the connected ends of the first pole and the second pole and configured to limit a rotating angle of the first and second poles.

In some aspects, the vertical poles, the eave pole or both the vertical poles and the eave pole are retractable poles.

In some aspects, the high-ceiling tent frame comprise at least two frame units, wherein two adjacent frame units are connected to each other by sharing at least two vertical poles.

The present invention has at least the following beneficial effects.

By arranging the supporting top pole groups between the vertical poles and the center pole, pressure applied to the center pole can be dispersed to vertical poles and thus the structure is stable. Since each supporting top pole group is formed by a plurality of first connecting pole units, each of which includes two first connecting poles, the first connecting poles can support with each other and thus the tent frame is more stable. Since the first connecting poles form the X-shape when unfolded and a quadrilateral structure is formed between two groups of first connecting pole units, the first connecting pole units can be used for hanging items.

Since the elongated slot is formed in the center pole or the side wall of the blind hole, the spring is arranged between the center pole and the center fixed connecting base. The spring is in a compressed state when the tent frame is unfolded and applies an upward force to the center pole. The center pole is pushed upward, tightening the tent fabric and thus reducing formation of pits and preventing water accumulation.

By arranging the water accumulation preventing pole group(s), the tent fabric can be further tightened. The tent poles can also support the tent fabric, and thus reduce formation of pits and prevent water accumulation.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
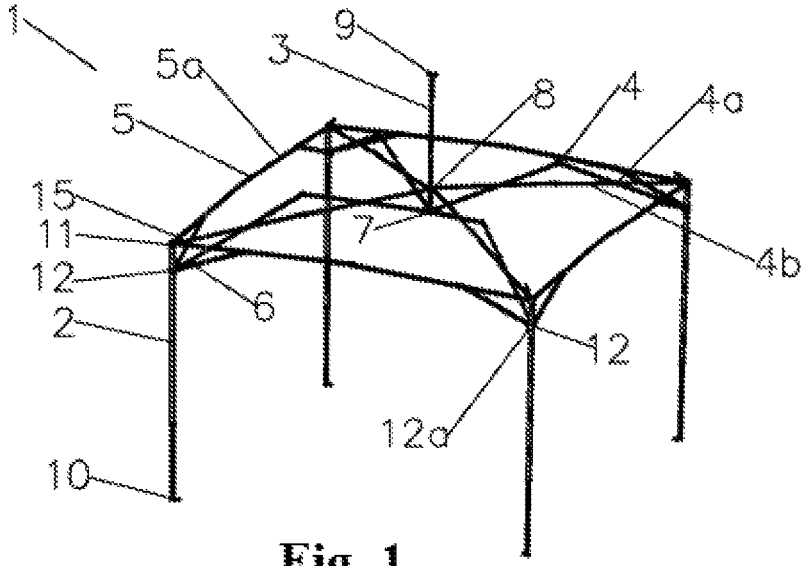
FIG. 1 is a schematic diagram illustrating a first exemplary high-ceiling tent frame according to some embodiments of the present invention.

Partial hinging pins are omitted in the drawings and numeral references in the drawings correspond to the follows:

1—frame unit;
2, 101, 201—vertical pole;
3, 102, 202—center pole;
3*a*—slot structure;
4, 103, 203—supporting top pole group;
4*a*, 103*a*, 231—first connecting pole unit;
4*b*, 103*b*, 2311—first connecting pole;
5, 104, 204—side top pole group;
5*a*—side top pole;
6, 105, 252—oblique supporting pole;
7, 106—center fixed connecting base;
8, 107—center slidable connecting base;
9, 15, 108—supporting piece;
10, 109—bottom foot piece;
11, 110, 210—vertical pole fixed connecting base;
12, 111, 211—vertical pole slidable connecting base;
12*a*, 111*a*, 211*a*—stop device;
13—compression spring;
14—pin;
15*a*—connecting part;
15*b*—horizontal pole;
102*a*, 106*d*—pin hole;
102*b*—elongated slot;
104*a*—side top pole;
106*a*—first connecting pole hinging part;
106*b*—blind hole;

106*c*—elongated slot;
112—connecting pin;
113—spring;
114—inner plug;
115—eave supporting pole;
116, 118—eave moving pole;
117—connecting part or sheet;
118*a*—first straight pole;
118*b*—second straight pole;
118*c*—stop block;
119—fabric supporting pole;
120, 207—slidable connecting piece;
121—stepped metal sheet;
231*a*—upper hinging point;
231*b*—lower hinging point;
2312—center hinging point;
241—second connecting pole unit;
2411—second connecting pole;
205, 208—inner horizontal pole group;
251—short pole;
206—fixed connecting base;
281—third connecting pole unit;
2811—third connecting pole.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A high-ceiling tent frame of the present invention in general comprises one or more frame units such as frame unit 1. The specific number of the frame units can be determined or adjusted according to the actually needed internal space of the tent or personal preference. In embodiments with two or more frame units, the adjacent frame units are connected to each other, for example by sharing vertical poles. By way of illustration and for describing structures of frame unit 1, FIG. 1 illustrates a first exemplary high-ceiling tent frame with one frame unit 1.

In some embodiments, the frame unit 1 comprises three or more vertical poles 2. The specific number of the vertical poles 2 can also be determined or adjusted according to the needed internal space of the tent or personal preference. As an example, FIG. 1 illustrates four vertical poles 2 arranged in a square shape. In some embodiments, the frame unit 1 also includes a center pole 3 and a supporting top pole group 4 used for connecting the center pole 3 with the vertical poles 2. When in use, top ends of the vertical poles 2 and the center pole 3 are in direct contact with and support the tent fabric. In some embodiments, the vertical poles 2 are retractable poles. In some embodiments, side top pole groups 5 are connected between every two adjacent vertical poles 2 and an oblique supporting pole 6 is additionally connected between each vertical pole 2 and each side top pole group 5 connected with this vertical pole 2. Side top pole groups 5 and the oblique supporting poles 6 strengthen the tent frame, making it firmer when the tent frame is unfolded. However, it should be understood that the side top pole groups 5 and the oblique supporting poles 6 are optional or additional components, not necessary for the tent frame of the present invention.

The center pole 3 is placed vertically or substantially vertically when the tent frame is unfolded. In some embodiments, a center fixed connecting base 7 is installed at a bottom end of the center pole 3. A center slidable connecting base 8 which can slide on the center pole 3 is installed on a pole body of the center pole 3. A supporting piece 9 used for supporting the tent fabric is installed at a top end of the center pole 3.

In some embodiments, the vertical poles 2 are placed vertically or substantially vertically when the tent frame is unfolded. In some embodiments, the vertical poles 2 is obliquely placed at a predetermined tilt angle relative to the ground. In some embodiments, bottom foot pieces 10 are installed at bottom ends of the vertical poles 2. Vertical pole fixed connecting bases 11 are installed at top ends of the vertical poles 2. Vertical pole slidable connecting bases 12 which can slide along the vertical poles 2 are installed on pole bodies of the vertical poles 2.

In some embodiments, the vertical pole slidable connecting bases 12 are provided with stop devices 12*a* for preventing the vertical pole slidable connecting bases 12 from falling downwards along the pole bodies of the vertical poles 2 when the tent frame is unfolded.

The center fixed connecting base 7, the center slidable connecting base 8, the supporting piece 9, the bottom foot pieces 10, the vertical pole fixed connecting bases 11, the vertical pole slidable connecting bases 12 and the stop devices 12*a* are the same or similar to those in the art and are thus not described herein in details.

Figure 2:
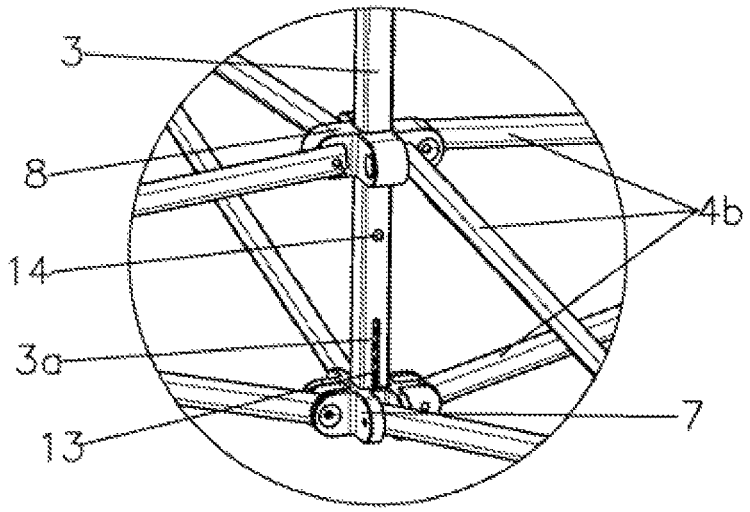
FIG. 2 is a partially enlarged view of FIG. 1, illustrating connection structures at or adjacent to a bottom part of a center pole of the high-ceiling tent frame.

In some embodiments, for example as shown in FIG. 2, the first exemplary high-ceiling tent frame further comprises a compression spring 13. In addition, in some embodiments, the center pole 3 is a hollow pole. A pin 14 is inserted into the pole body of the center pole 3 close to a position at which the center fixed connecting base 7 is installed. The compression spring 13 is installed in the center pole 3, where one end of the compression spring 13 presses against the center fixed connecting base 7, and the other end presses against the pin 14. The compression spring 13 is always in a compressed state after being installed in the center pole 3 and thus provides an upward elastic force to the center pole 3. As such, the tent fabric supported by the center pole 3 is always in a tightened state when the tent frame is unfolded to prevent water from being accumulated on rainy days.

In some embodiments, a slot structure 3*a* is formed at the center pole, at a position where the compression spring 13 is installed. The length of the slot structure 3*a* can be equal to or slightly smaller than the length of the compression spring 13. The slot structure 3*a* facilitates the observation of the working state of the compression spring 13, and the installation and replacement of the compression spring 13.

Figure 3:
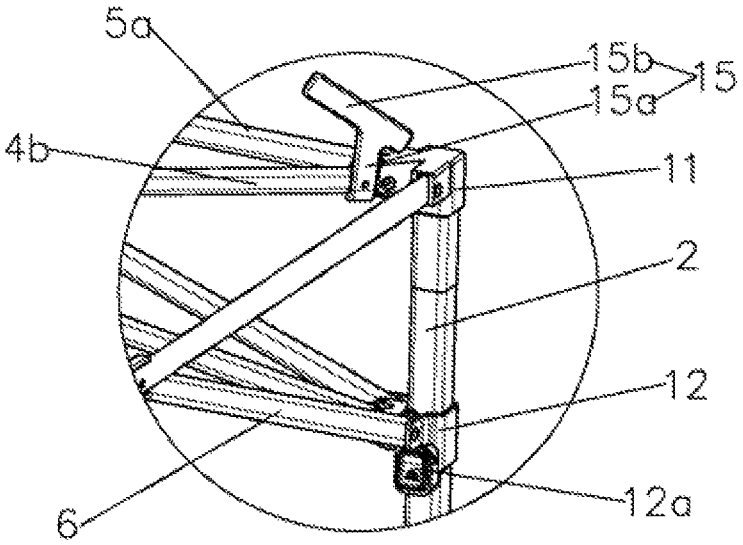
FIG. 3 is a partially enlarged view of FIG. 1, illustrating connection structures of top parts of vertical poles of the high-ceiling tent frame.

In some embodiments, each supporting top pole group 4 comprises one or more first connecting pole units 4*a* which are pivotally connected to each other. For example, each supporting top pole group 4 comprises two first connecting pole units 4*a*. Each first connecting pole unit 4*a* comprises two first connecting poles 4*b* which are pivotally connected to each other and form an X-shape when the tent frame is unfolded. In each supporting top pole group 4, as shown in FIG. 2, one first connecting pole 4*b* of the first connecting pole unit 4*a* connected with the center pole 3 is pivotally connected to the center pole 3 through the center slidable connecting base 8, and the other first connecting pole 4*b* is pivotally connected to the center pole 3 through the center fixed connecting base 7. As shown in FIG. 3, one first connecting pole 4*b* of the first connecting pole unit 4*a* connected with the vertical poles 2 is pivotally connected to the vertical poles 2 through the vertical pole slidable connecting bases 12. The other first connecting pole 4*b* is pivotally connected to the vertical poles 2 through the vertical pole fixed connecting bases 11. Pivotal connection disclosed herein can be achieved by pins, hinges, bolts, screws or the like.

In some embodiments, a supporting piece 15 is additionally or optionally installed on this first connecting pole 4*b*. The supporting piece 15 comprises a connecting part 15*a* fixedly connected with the first connecting pole 4*b* and a horizontal pole 15*b* used for supporting the tent fabric. In one embodiment, the connecting part 15*a* is fixed on the first connecting pole 4*b* through a pin. The horizontal pole 15*b* and the connecting part 15*a* are fixedly connected according to a predetermined angle, and the specific angle can be determined according to the actual needs or personal preference as long as the horizontal pole 15*b* can support the tent fabric when the tent or tent frame is unfolded. By way of illustration, FIG. 3 shows only one supporting piece 15 installed on the first connecting pole 4*b*. However, it should be understood that a plurality of supporting pieces 15 can be installed on the same first connecting pole 4*b* according to the actual needs or preference.

In some embodiments, each side top pole group 5 comprises two side top poles 5*a* which are pivotally connected to each other and form a substantially straight line when the tent frame is unfolded. For example, as shown in FIG. 1, certain ends, which are not pivotally connected to each other, of the side top poles 5*a* are pivotally connected to the vertical poles 2 through the vertical pole fixed connecting bases 11.

In some embodiments, one end of each oblique supporting pole 6 is connected with the vertical pole 2 through the vertical pole slidable connecting base 12, and the other end is pivotally connected to the side top pole 5*a* pivotally connected to the same one vertical pole 2. When the tent frame is unfolded, the vertical pole 2, one section of the side top pole 5*a* and the oblique supporting pole 6 form a triangle. In one embodiment, two side top poles 5*a* and two oblique supporting poles 6 are pivotally connected to each vertical pole 2.

As shown in FIG. 1, in some embodiments, to unfold the tent or the tent frame, the vertical poles 2 of the tent frame are placed vertically or substantially vertically and are pulled open to predetermined positions. The vertical pole slidable connecting bases 12 are slid or simultaneously slid upwards to predetermined positions. The vertical pole slidable connecting bases 12 are fixed on the vertical poles 2 by the stop devices 12*a*. The bottom foot pieces 10 are fixed on the ground and thus the unfolding of the tent frame is realized. The tent fabric is placed on the tent frame, prior to or subsequent to the unfolding of the tent frame. The tent fabric is supported by the supporting pieces 9, the supporting pieces 15 and the top parts of the vertical poles 2.

Figure 4:
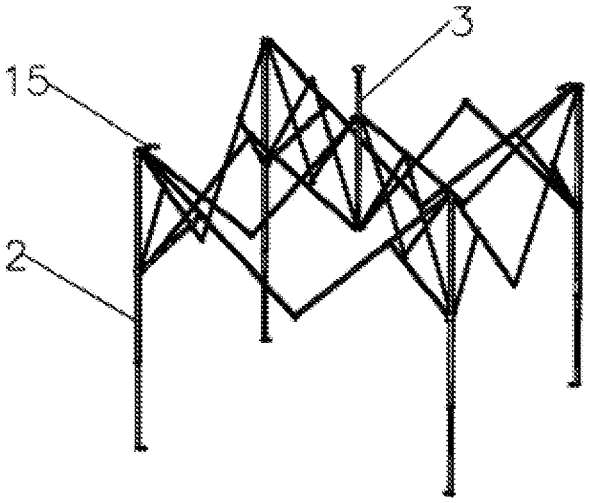
FIG. 4 is a schematic diagram illustrating the high-ceiling tent frame of FIG. 1 in a folding process.
Figure 5:
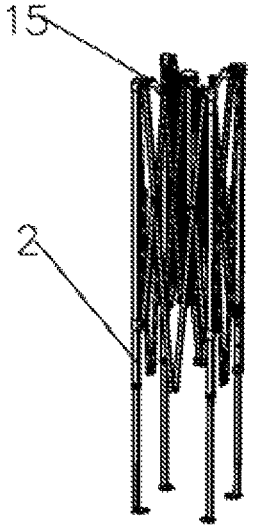
FIG. 5 is a schematic diagram illustrating the high-ceiling tent frame of FIG. 1 in a folded state.

As shown in FIG. 4, in some embodiments, to fold the tent or the tent frame, the tent fabric is retrieved or put away. The bottom foot pieces 10 and the stop devices 12*a* are loosened. The vertical poles 2 are retracted or simultaneously retracted to a shorter or the shortest state. Then the vertical pole slidable connecting bases 12 are slid downwards. The two first connecting poles 4*b* on each connecting pole unit 4*a* are respectively clockwise and anticlockwise rotated. The four vertical poles 2 are driven to move towards the direction of the center pole 3. The center slidable connecting base 8 slides upwards along the center pole 3 under the drive of the first connecting pole units 4*a*. The center fixed connecting base 7 moves downwards together with the center pole 3 under the drive of the first connecting pole units 4*a*. At the end, all poles are folded together as shown in FIG. 5.

Figure 6:
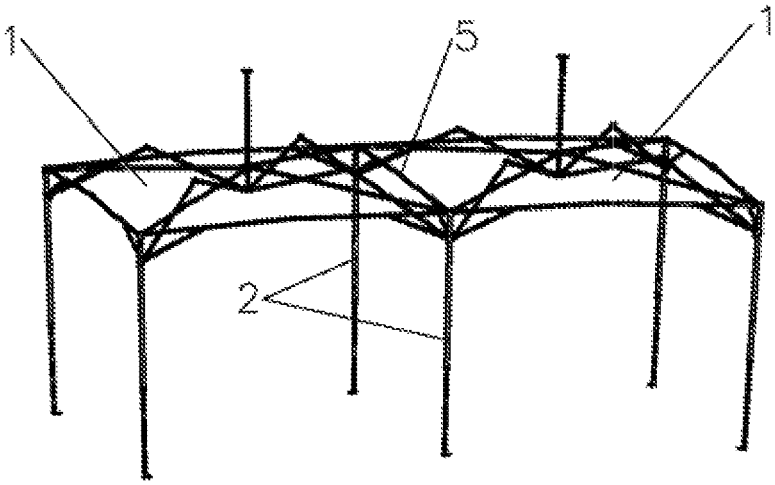
FIG. 6 is a schematic diagram illustrating a second exemplary high-ceiling tent frame according to some embodiments of the present invention.

Referring to FIG. 6, there depicts a second exemplary high-ceiling tent frame according to some embodiments of the present invention. As shown in FIG. 6, in some embodiments, a tent frame of the present invention comprises two frame units 1 connected with each other. Each frame unit 1 is the same or substantially the same as the frame unit 1 in the first exemplary high-ceiling tent frame disclosed above.

In some embodiments, the two frame units 1 share two vertical poles 2 and a side top pole group 5. It should be understood that the number of the frame units 1 is readily adjustable. In some embodiments, the tent frame includes more than two frame units 1, in which two adjacent frame units are connected to each other by sharing two vertical poles 2 and one side top pole group 5. In some embodiments, the tent frame includes the supporting pieces 15. The supporting pieces 15 are optional, and in some embodiments, the tent frame does not include the supporting pieces 15.

The folding and folding process of the second exemplary high-ceiling tent frame is similar to that of the first exemplary high-ceiling tent frame, and thus is not described herein in details.

Figure 7:
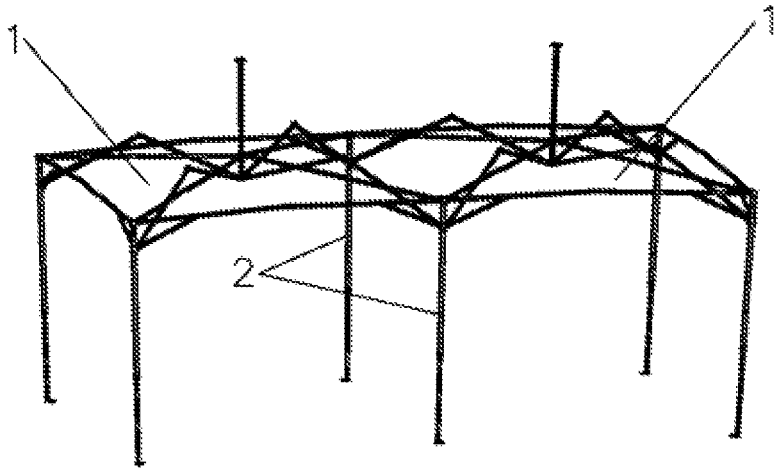
FIG. 7 is a schematic diagram illustrating a third exemplary high-ceiling tent frame according to some embodiments of the present invention.

Referring to FIG. 7, there depicts a third exemplary high-ceiling tent frame according to some embodiments of the present invention. As shown in FIG. 7, the third exemplary high-ceiling tent frame comprises two frame units 1 connected with each other. The frame unit of the third exemplary high-ceiling tent frame is substantially the same as that of the first exemplary high-ceiling tent frame, except the arrangement of the side top pole groups 5 and the oblique top poles 6 is different. As shown in FIG. 7, two frame units 1 share two vertical poles 2.

In consideration of that the stress at a connecting position between the two frame units 1 is small, the third exemplary high-ceiling tent frame is configured such that except the vertical poles 2 shared by the two frame units 1, side top pole groups 5 are connected between every two adjacent vertical poles 2. That is, no side top pole group 5 is arranged between the two vertical poles 2 shared by the two frame units 1. Since the side top pole group 5 is not arranged, corresponding oblique top poles 6 are not arranged either. As a result, the assembling process is simplified and the cost is reduced.

It should be understood that the number of the frame units 1 is readily adjustable. In some embodiments, the tent frame includes more than two frame units 1, in which two adjacent frame units are connected to each other by sharing two vertical poles 2. In addition, it should be understood that the supporting pieces 15 are additional or optional components.

The folding and folding process of the third exemplary high-ceiling tent frame is similar to that of the first exemplary high-ceiling tent frame, and thus is not described herein in details.

Figure 8:
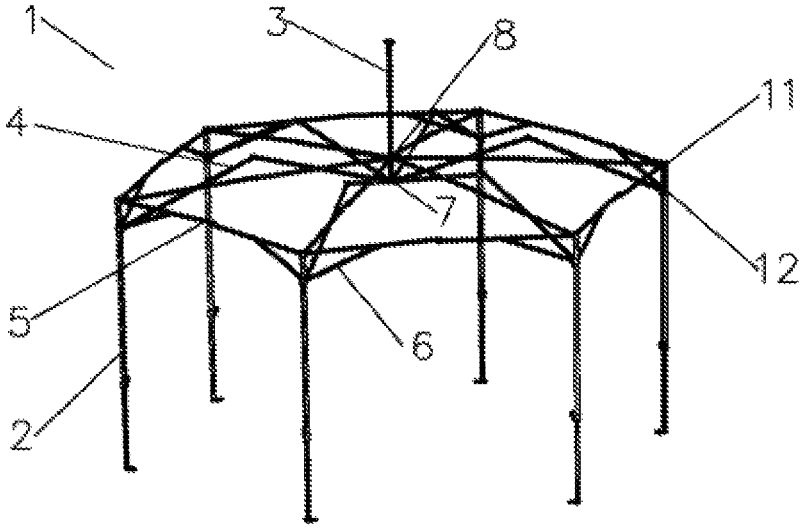
FIG. 8 is a schematic diagram illustrating a fourth exemplary high-ceiling tent frame according to some embodiments of the present invention.

Referring now to FIG. 8, there depicts a fourth exemplary high-ceiling tent frame according to some embodiments of the present invention. As shown in FIG. 8, the fourth exemplary high-ceiling tent frame includes a frame unit 1 that has six vertical poles 2. By way of illustration, the six vertical poles 2 in FIG. 8 is arranged in a regular hexagon shape. In the illustrated embodiment, there is no supporting pieces 15 arranged on the tent frame. However, it should be understood that the tent frame can include the supporting pieces 15 according to actual needs or preference.

The folding and folding process of the fourth exemplary high-ceiling tent frame is similar to that of the first exemplary high-ceiling tent frame, and thus is not described herein in details.

Figure 9:
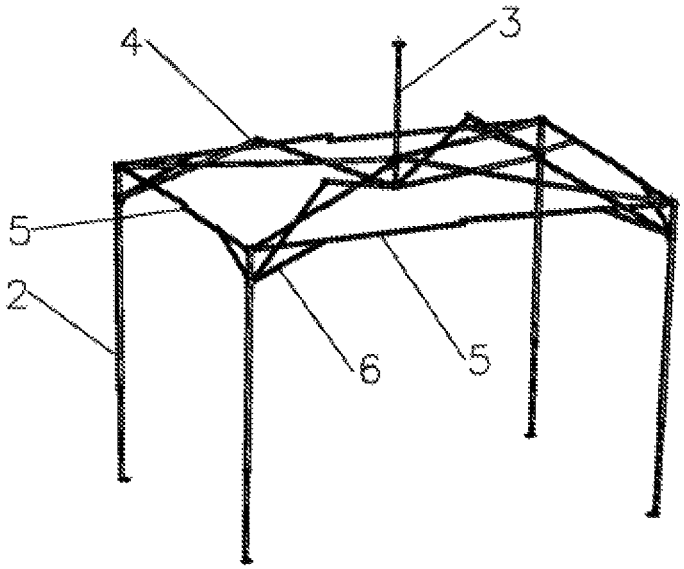
FIG. 9 is a schematic diagram illustrating a fifth exemplary high-ceiling tent frame according to some embodiments of the present invention.

Referring to FIG. 9, there depicts a fifth exemplary high-ceiling tent frame according to some embodiments of the present invention. Conventional tent frames are limited by the folding structure and their vertical poles are generally arranged in a regular polygon shape. Unlike the conventional tent frames, the fifth exemplary high-ceiling tent frame has side top pole groups 5 with different lengths and four vertical poles 2 arranged in a rectangle shape.

The folding and folding process of the fifth exemplary high-ceiling tent frame is similar to that of the first exemplary high-ceiling tent frame, and thus is not described herein in details.

Figure 10:
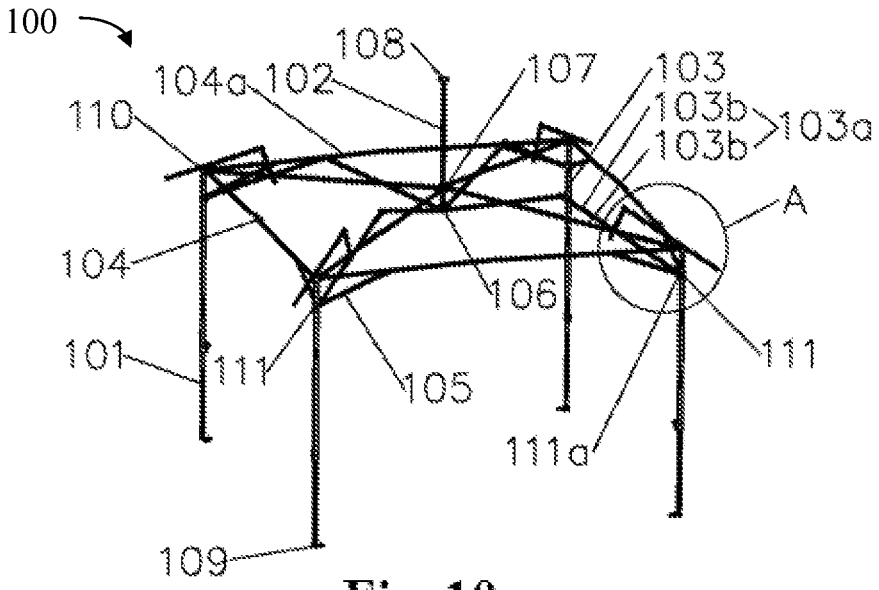
FIG. 10 is a schematic diagram illustrating a sixth exemplary high-ceiling tent frame according to some embodiments of the present invention.

Referring to FIG. 10, there depicts a sixth exemplary high-ceiling tent frame according to some embodiments of the present invention. As shown in FIG. 10, in some embodiments, a high-ceiling tent frame comprises one or more frame units 100 connected with each other. The specific number of the frame units 100 can be determined according to the actually needed internal space and/or personal preference. By way of illustration, FIG. 10 depicts the sixth exemplary high-ceiling tent frame includes one frame unit.

In some embodiments, the frame unit 100 comprises four vertical poles 101 and a center pole 102. Top ends of the vertical poles 101 and the center pole 102 are in direct contact with and support a tent fabric. In some embodiments, the frame unit 100 comprises three, five or more than five of the vertical poles 101, or any number of the vertical poles 101 according to the actual needs, desire or preference. In some embodiments, the vertical poles 101 are retractable poles.

In some embodiments, supporting top pole group 103 is connected between the center pole 102 and each vertical pole 101. Side top pole groups 104 are connected between every two adjacent vertical poles 101, and additional or optional oblique supporting poles 105 are connected between each vertical pole 101 and each side top pole group 104 connected with this vertical pole 101.

Figure 11:
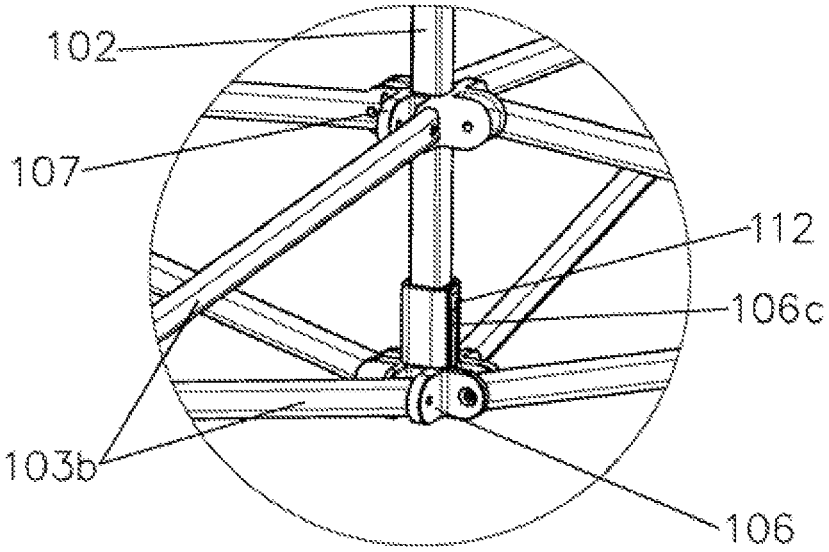
FIG. 11 is a partially enlarged view of FIG. 10, illustrating connection structures at or adjacent to a bottom part of a center pole of the high-ceiling tent frame.

As shown in FIG. 10 and FIG. 11, when tent frame is unfolded, the center pole 102 is placed vertically or substantially vertically at a top part of the tent. A center fixed connecting base 106 is installed at a bottom end of the center pole 102. A center slidable connecting base 107 which can slide on the center pole 102 is installed on a pole body of the center pole 102. A supporting piece 108 used for supporting the tent is installed at a top end of the center pole 102. In some embodiments, when the tent frame is unfolded, the vertical poles 101 are placed vertically or substantially vertically. In some embodiments, the vertical poles 101 are placed obliquely at a predetermined tilt angle relative to the ground according to the actual needs or preference.

In some embodiments, bottom foot pieces 109 are installed at bottom ends of the vertical poles 101. Vertical pole fixed connecting bases 110 are installed at top ends of the vertical poles 101. Vertical pole slidable connecting bases 111 which can slide along the vertical poles 101 are installed on pole bodies of the vertical poles 101. The vertical pole slidable connecting bases 111 are provided with stop devices 111*a* for preventing the vertical pole slidable connecting bases 111 from sliding downwards along the pole bodies of the vertical poles 101 when the tent frame is unfolded.

The center slidable connecting base 107, the bottom foot pieces 109, the vertical pole fixed connecting bases 110, the vertical pole slidable connecting bases 111 and the stop devices 111*a* are the same as or similar to those in the art and are not described herein in details.

Figure 12:
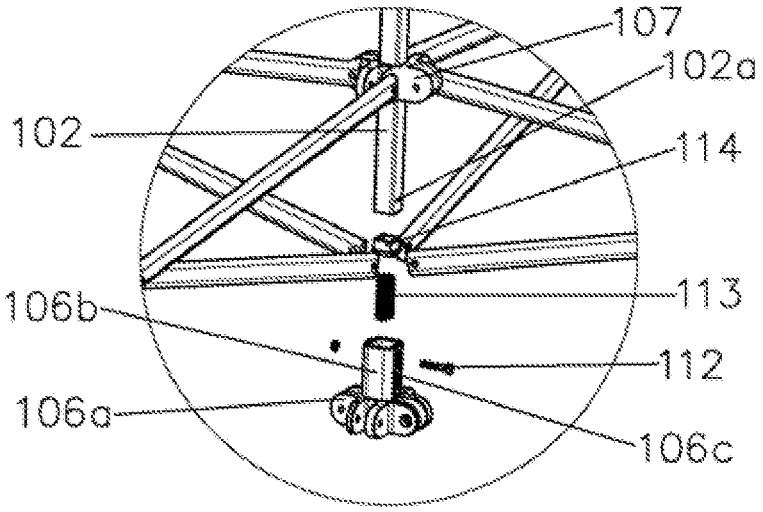
FIG. 12 is a partial exploded view of FIG. 11.
Figure 13:
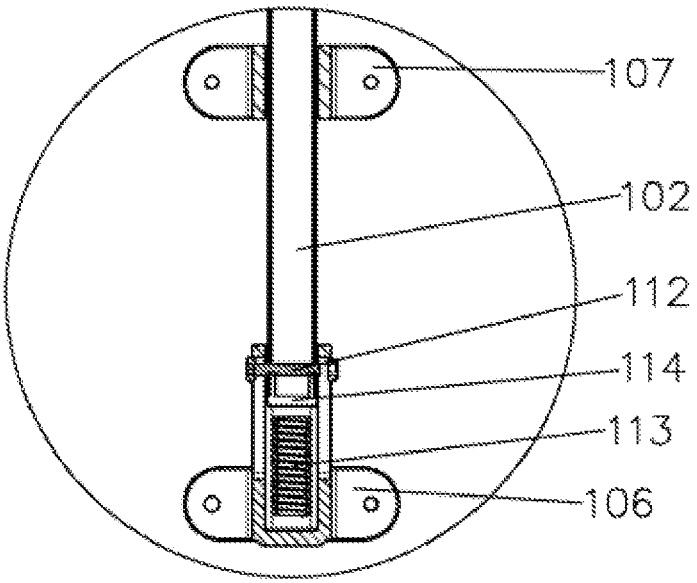
FIG. 13 is a sectional and partially enlarged view of FIG. 10, illustrating connection structures at or adjacent to a bottom part of a center pole of the high-ceiling tent frame.

As shown in FIG. 11 to FIG. 13, in some embodiments, a connecting pin 112 and a spring 113 are arranged between the center pole 102 and the center fixed connecting base 106. The connecting pin 112 can be a common pin or screw, and the spring 113 is a compression spring. A pin hole 102*a* is formed at the bottom end of the center pole 102. The center fixed connecting base 106 has a first connecting pole hinging part 106*a* which is fit with or receives the first connecting poles 103*b* of the tent and a blind hole 106*b* which is fit with or receives the center pole 102.

The arrangement positions of the first connecting poles 103*b* will be described below. In some embodiments, the first connecting pole hinging part 106*a* is pivotally connected to the first connecting poles 103*b*. An elongated slot 106*c* is formed in a side wall of the blind hole 106*b*, and a length direction of the elongated slot 106*c* is the same as a length direction of the center pole 102 and is also the same as a depth direction of the blind hole 106*b*. The connecting pin 112 penetrates through the elongated slot 106*c* and the pin hole 102*a* to connect the center pole 102 with the center fixed connecting base 106. The spring 113 is placed in the blind hole 106*b*. One end of the spring 113 presses against the bottom end of the center pole 102 and the other end presses against a bottom part of the blind hole 106*b*.

In some embodiments, the center pole 102 is hollow. In such embodiments, an inner plug 114 is preferably installed at the bottom end of the center pole 102 to prevent the spring 113 from being inserted into the center pole and ensure the spring work normally.

It should be understood that the elongated slot 106*c* and the pin hole 102*a* can be configured differently. For example, in one embodiment, the elongated slot is formed in the center pole 102 instead of on the side wall of the blind hole, and the pin hole is formed on the side wall of the blind hole 106*b* instead of in the center pole 102. However, in consideration of that the center pole 102 is generally hardware and the center fixed connecting base 106 in which the blind hole 106*b* is formed is generally a plastic piece, the cost of forming the elongated slot in the side wall of the blind hole 106*b* is much lower than that of forming the elongated slot in the center pole 102.

When the tent is unfolded, the tent applies downward pressure to the center pole 102 and the center pole 102 transfers the pressure to the spring 113, such that the spring 113 is enabled to be in a compressed state and thus provide an upward elastic force to the center pole 102. Consequently, the tent fabric supported by the center pole 102 is always in a tightened state when the tent is unfolded.

As shown in FIG. 10, in some embodiments, each supporting top pole group 103 comprises one or more first connecting pole units 103*a* which are pivotally connected to each other. In some embodiments, each supporting top pole group 103 comprises two first connecting pole units 103*a*. Each first connecting pole unit 103*a* comprises two first connecting poles 103*b* which are pivotally connected to each other and form an X-shape when unfolded.

In each supporting top pole group 103, one first connecting pole 103*b* of the first connecting pole unit 103*a* connected with the center pole 102 is pivotally connected to the center pole 102 through the center slidable connecting base 107, and the other first connecting pole 103*b* is pivotally connected to the center pole 102 through the first connecting pole hinging part 106*a* of the center fixed connecting base 106. One first connecting pole 103*b* of the first connecting pole unit 103*a* connected with the vertical poles 101 is pivotally connected to the vertical poles 101 through the vertical pole slidable connecting bases 111, and the other first connecting pole 103*b* is pivotally connected to the vertical poles 101 through the vertical pole fixed connecting bases 110.

Figure 14:
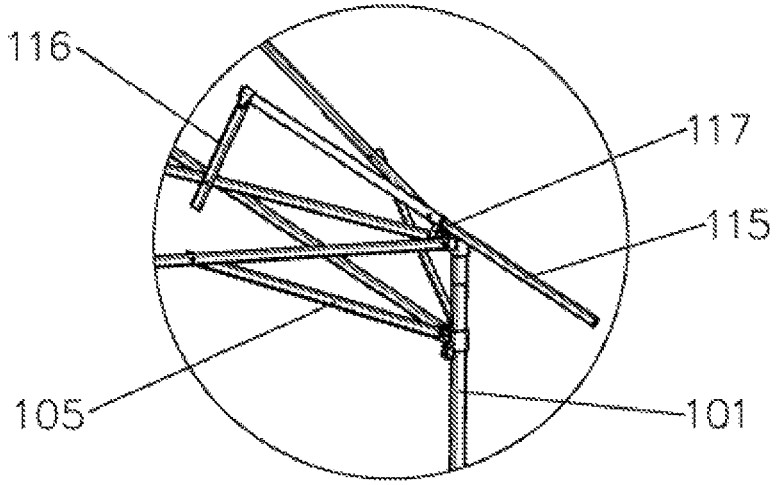
FIG. 14 is a partial enlarged view of A in FIG. 10.

As shown in FIG. 14, in some embodiments, the tent frame further comprises a water accumulation preventing pole group. In some embodiments, the water accumulation preventing pole group comprises an eave supporting pole 115, an eave moving pole 116 and a connecting part or sheet 117. In one embodiment, the eave moving pole 116 is a straight pole, and the eave supporting pole 115 is preferably a retractable pole. One end of the eave supporting pole 115 is pivotally connected to one end of the eave moving pole 116 and the other end of the eave supporting pole 115 is suspended in the air. The other end or a pole body of the eave moving pole 116 is pivotally connected to the first connecting pole unit 103*a* connected with the vertical poles 101. Preferably, the eave moving pole 116 is pivotally connected to the first connecting pole unit 103*a*, for example, at a hinging position of two first connecting poles 103*b* of the first connecting pole unit 103*a*.

In some embodiments, the connecting part or sheet 117 is the same as or similar to that in the art. One end of the connecting sheet 117 is pivotally connected to the pole body of the eave supporting pole 115, and the other end is pivotally connected to the first connecting pole 103*b* pivotally connected to the vertical pole fixed connecting bases 110. Once connected, the connecting sheet 117 can rotate relative to the eave supporting pole 115 or the first connecting pole 103*b* around the hinging point.

As shown in FIG. 10, in some embodiments, each side top pole group 104 comprises two side top poles 104*a*, one ends of which are pivotally connected to each other such that the two side top poles 104*a* form a substantially straight line when unfolded. The other ends, which are not pivotally connected to each other, of the side top poles 104*a* are pivotally connected to the vertical poles 101 through the vertical pole fixed connecting bases 110.

In some embodiments, one end of each oblique supporting pole 105 is connected to the vertical pole 101 through the vertical pole slidable connecting base 111, and the other end is pivotally connected to the side top pole 104*a* that is pivotally connected to the same one vertical pole 101. The vertical pole 101, the side top pole 104*a* and the oblique supporting pole 105 form a triangle when the tent frame is unfolded. In some embodiments, two side top poles 104*a* and two oblique supporting poles 105 are pivotally connected to each vertical pole 101.

To unfold the tent or tent frame, the vertical poles 101 of the folded tent frame are placed vertically or substantially vertically and are pulled open to predetermined positions. The vertical pole slidable connecting bases 111 are slid or simultaneously slid upwards to predetermined positions. The vertical pole slidable connecting bases 111 are fixed on the vertical poles 101 by the stop devices 111*a*. The bottom foot pieces 109 are fixed on the ground and thus the unfolding of the tent frame can be realized. The tent fabric is placed on the tent frame, prior to or subsequent to the unfolding of the tent frame. The tent fabric is supported by the supporting pieces 108, the top parts of the vertical poles 101 and the eave supporting poles. The tent fabric at the position of the center pole 102 is preferably pressed downwards as much as possible to enable the spring 113 have enough compression. In some embodiments, after the tent is unfolded, the eave supporting poles 115 is adjusted to proper positions by manually operating the eave moving poles 116. In some embodiments, manual operation is performed during folding.

The folding process of the tent frame is similar to that of a conventional tent frame, and thus is not described herein in details.

Figure 15:
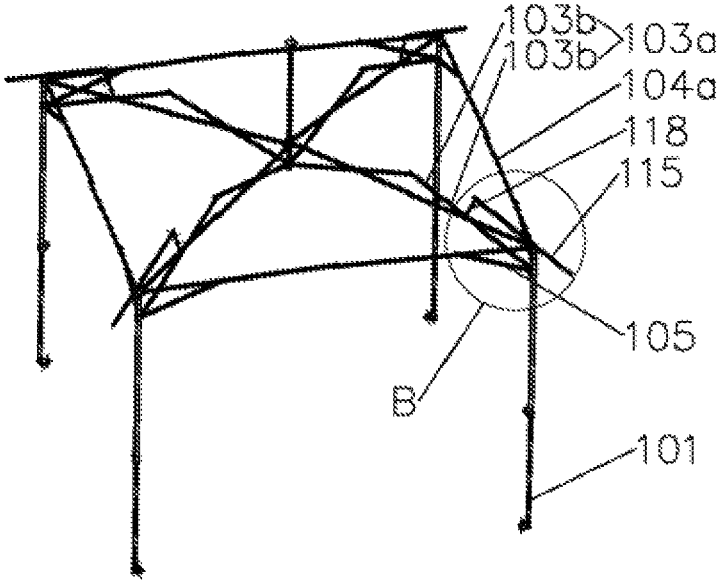
FIG. 15 is a schematic diagram illustrating a seventh exemplary high-ceiling tent frame according to some embodiments of the present invention.

Referring to FIG. 15, there depicts a seventh exemplary high-ceiling tent frame according to some embodiments of the present invention. The seventh exemplary high-ceiling tent frame is similar to the sixth exemplary high-ceiling tent frame, except the structures and connecting methods of a center pole 102 and a center fixed connecting base 106 are different and the structure of an eave moving pole of a water accumulation preventing pole group is different.

Figure 16:
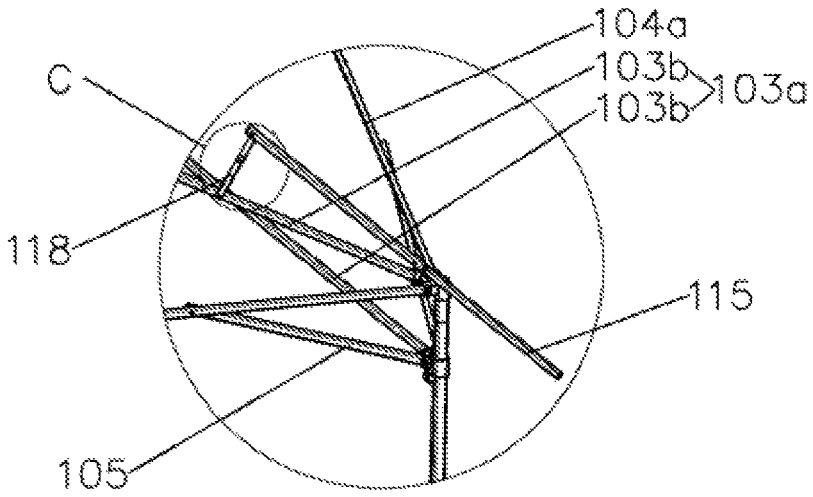
FIG. 16 is a partial enlarged view of B in FIG. 15.
Figure 17:
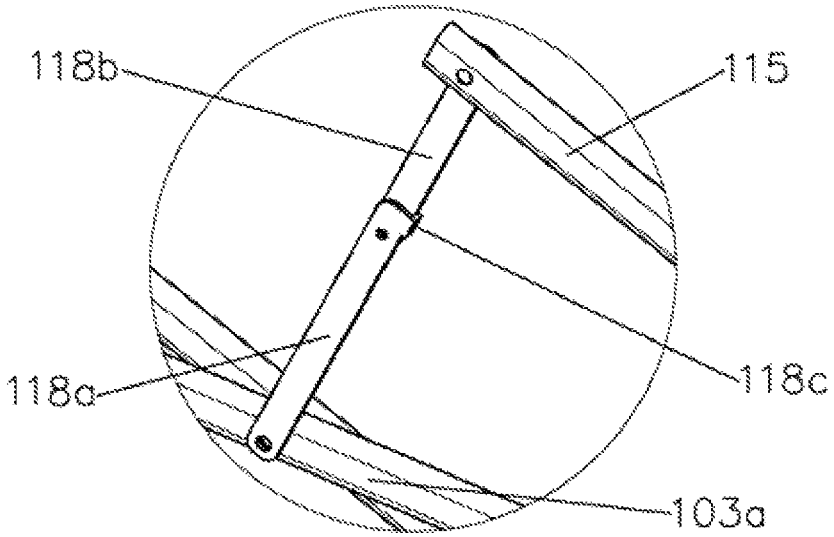
FIG. 17 is a partial enlarged view of C in FIG. 16.

As shown in FIG. 15 to FIG. 17, in some embodiments, the eave moving pole 118 of the seventh exemplary high-ceiling tent frame has a first pole 118*a* and a second pole 118*b*, certain ends of which are rotatably connected with each other. In some embodiments, the first and second pole 118*a*, 118*b* are straight or substantially straight poles. A stop block 118*c* used for limiting a rotating angle is arranged at the connected certain ends of the first straight pole 118*a* and the second straight pole 118*b*.

The other end, which is not connected with the second straight pole 118*b*, of the first straight pole 118*a* is pivotally connected to the first connecting pole unit 103*a* connected with the vertical poles 101, and preferably, is pivotally connected at a hinging position of the two first connecting poles 103*b* of the first connecting pole unit 103*a*. The other end, which is not connected with the first straight pole 118*a*, of the second straight pole 118*b* is pivotally connected to the eave supporting pole 115.

As shown in FIG. 16 and FIG. 17, after the tent is unfolded, the first straight pole 118*a* and the second straight pole 118*b* are rotated to enable the first straight pole 118*a* and the second straight pole 118*b* to be on the same line. At this moment, the stop block 118*c* starts to limit the position of the second straight pole 118*b* such that the second straight pole 118*b* cannot continuously rotate, and the eave supporting pole 115 is naturally unfolded under the drive of the second straight pole 118*b*.

Figure 18:
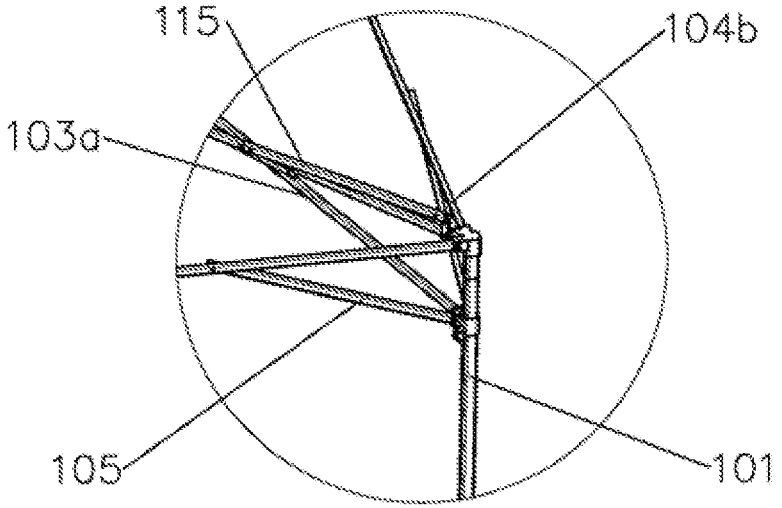
FIG. 18 is a partially enlarged view of FIG. 15, illustrating a folded eave supporting pole.

As shown in FIG. 18, before the tent is folded, firstly the eave supporting pole 115 is retracted to the shortest state. Then the first straight pole 118*a* and the second straight pole 118*b* are rotated in opposite directions to enable the first straight pole 118*a* and the second straight pole 118*b* to be overlapped with each other. The eave supporting pole 115 is naturally folded under the drive of the second straight pole 118*b*.

Figure 19:
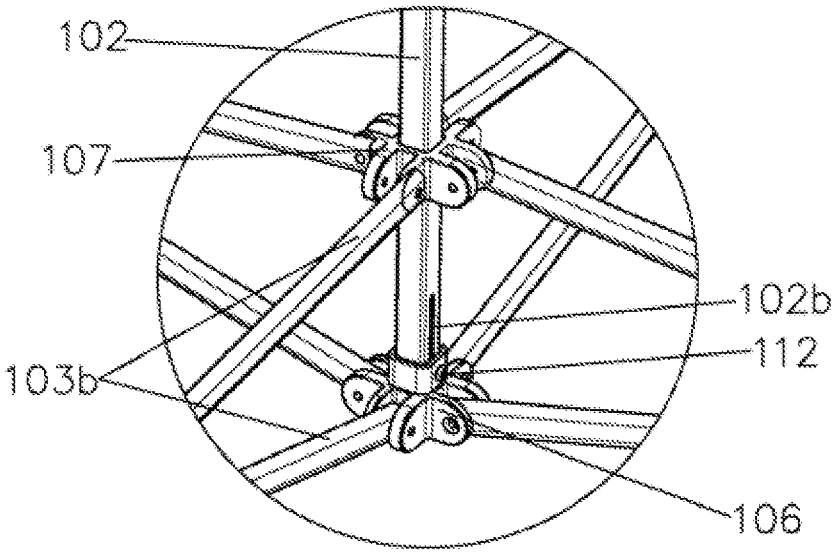
FIG. 19 is a partially enlarged view of FIG. 15, illustrating connection structures at or adjacent to a bottom part of a center pole of the high-ceiling tent frame.
Figure 20:
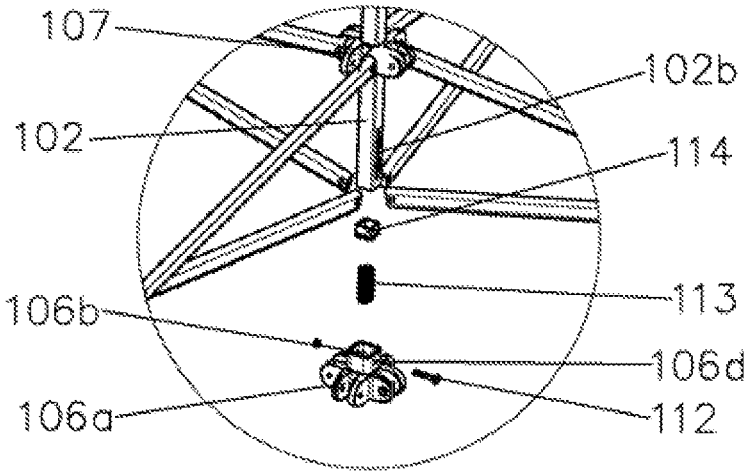
FIG. 20 is a partial exploded view of FIG. 19.
Figure 21:
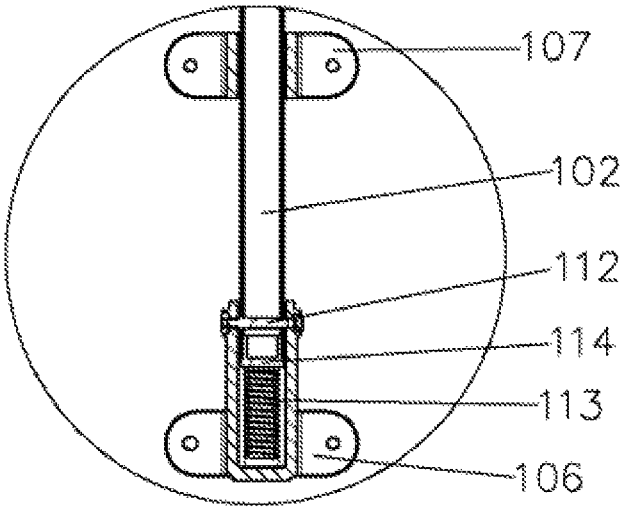
FIG. 21 is a sectional and partially enlarged view of FIG. 19, illustrating connection structures at or adjacent to a bottom part of a center pole of the high-ceiling tent frame.

As shown in FIG. 19 to FIG. 21, in some embodiments, an elongated slot 102*b* is formed at a bottom end or bottom end portion of the center pole 102. A length direction of the elongated slot 102*b* is the same as a length direction of the center pole 102. The center fixed connecting base 106 has a first connecting pole hinging part 106*a* which is fit with or receives the first connecting poles 103*b* of the tent and a blind hole 106*b* which is fit with or receives the center pole 102. Similar to some other embodiments disclosed herein, in some embodiments, the first connecting pole hinging part 106*a* and the first connecting poles 103*b* are pivoted together.

In some embodiments, a pin hole 106*d* is formed at a position, adjacent to a mouth part of the blind hole 106*b*, of the blind hole 106*b*. A connecting pin 112 penetrates through the elongated slot 102*b* and the pin hole 106*d* to connect the center pole 102 with the center fixed connecting base 106. A spring 113 is placed in the blind hole 106*b*. One end of the spring 113 presses against a bottom end of the center pole 102 and the other end presses against a bottom part of the blind hole 106*b*.

The unfolding and folding method of the seventh exemplary high-ceiling tent frame is the same as or similar to that of the sixth exemplary high-ceiling tent frame, and thus is not described herein in details.

Figure 22:
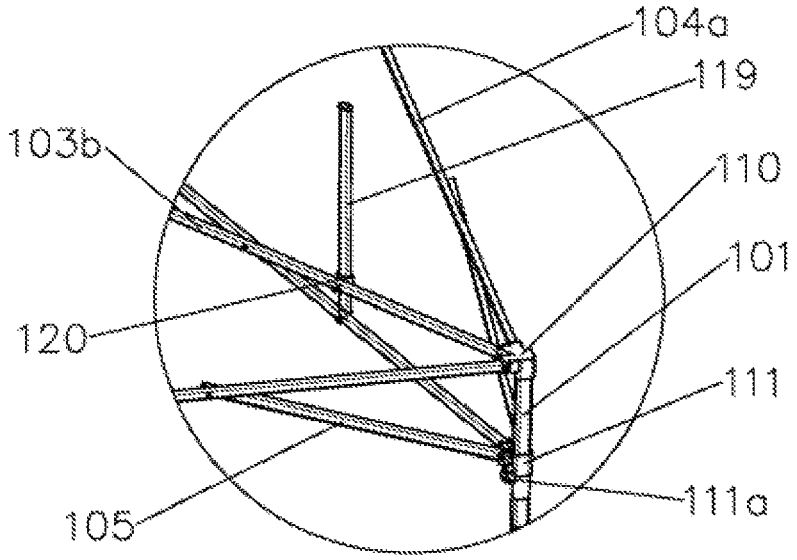
FIG. 22 is a schematic diagram illustrating an exemplary water accumulation preventing pole group according to some embodiments of the present invention.

Referring to FIG. 22, there depicts an exemplary water accumulation preventing pole group according to some embodiments of the present invention. As shown in FIG. 22, in some embodiments, the exemplary water accumulation preventing pole group comprises a fabric supporting pole 119 placed vertically or substantially vertically when the tent frame is unfolded. The length of the fabric supporting pole 119 can be set according to the actual needs or preference. One end of the fabric supporting pole 119 is pivotally connected to a first connecting pole 103*b* of a first connecting pole unit 3*a*. The other end of the fabric supporting pole 119 faces upwards. The pole body of the fabric supporting pole 119 is connected with the other first connecting pole 103*b* of the same first connecting pole unit 3*a* through a slidable connecting piece 120. The fabric supporting pole 119 is slidably connected with the slidable connecting piece 120. The slidable connecting piece 120 is pivotally connected to the other first connecting pole 103*b*.

In some embodiments, the slidable connecting piece 120 is the same as or similar to that used in the tent field. In some embodiments, the slidable connecting piece 120 is pivotally connected to the first connecting pole 103*b* through a pin and can rotate by taking the pin as a central axis. The fabric supporting pole 119 is inserted into the slidable connecting piece 120, and thus the slidable connecting piece 120 can slide on a pole body of the fabric supporting pole 119 to form sliding connection.

One end, which faces upwards, of the fabric supporting pole 119 supports a tent fabric, preventing sinking or sagging of the tent fabric between the vertical poles 101 and the center poles 102. As a result, the tent frame of the present invention prevents water from being accumulated between the vertical poles 101 and the center poles 102. By way of illustration, FIG. 22 shows only one fabric supporting pole 119 installed on a supporting top pole group 103. However, it should be understood that a plurality of fabric supporting pole 119 can be installed on the same supporting top pole group 103 or different supporting top pole groups according to the actual situations.

The unfolding and folding method of the tent frame with the exemplary water accumulation preventing pole group is similar to that of the sixth exemplary high-ceiling tent frame, and thus is not described herein in details.

Figure 23:
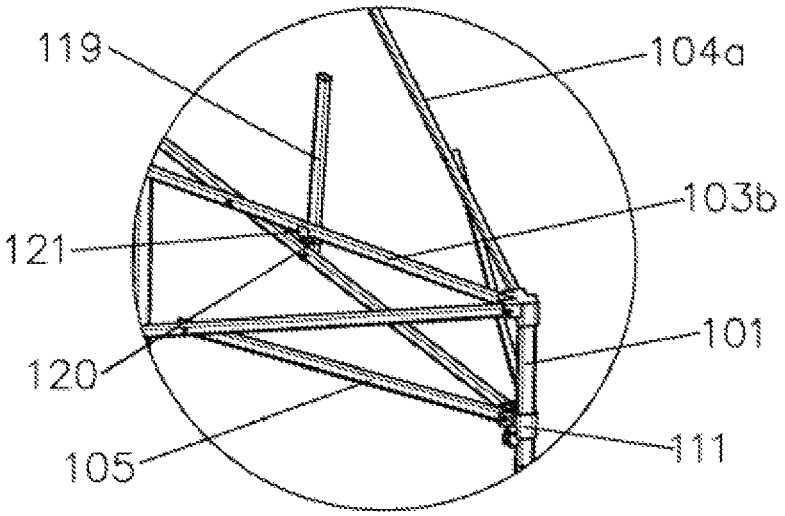
FIG. 23 is a schematic diagram illustrating an exemplary connection between a slidable connecting piece and a first connecting pole according to some embodiments of the present invention.
Figure 24:
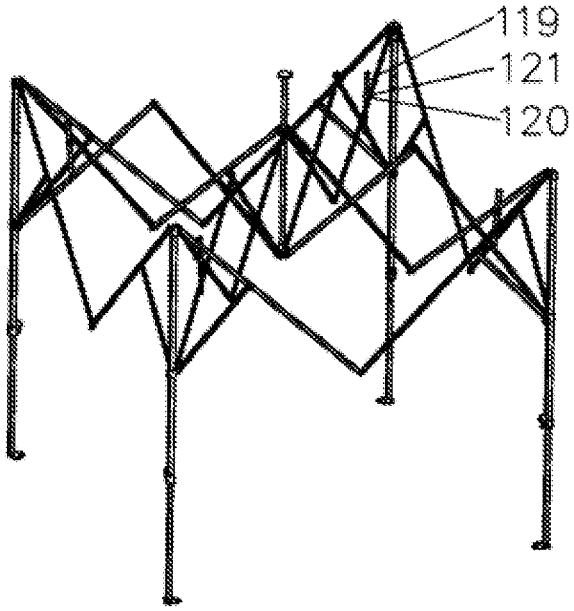
FIG. 24 is a schematic diagram illustrating a folding process of the second exemplary water accumulation preventing pole group in FIG. 23.

Referring to FIG. 23, there depicts an exemplary connection between a slidable connecting piece and a first connecting pole according to some embodiments of the present invention. The connection between a slidable connecting piece 120 and a first connecting pole 103*b* as shown in FIG. 23 is different from that of the sixth exemplary high-ceiling tent frame disclosed above.

As shown in FIG. 23, in some embodiments, a bracket 121 is pivotally connected to the slidable connecting piece 120. Herein, bracket refers to bracket, clip, bended or stepped sheet, stepped metal sheet or the like, and they are interchangeable. A slot structure is formed between a step of the stepped metal sheet 121 and the slidable connecting piece 120 after being connected. The first connecting pole 103*b* connected with the slidable connecting piece 120 is placed in the slot structure and is fixedly connected with the stepped metal sheet 121. Thus, the slidable connecting piece 120 is enabled to be indirectly pivotally connected to the first connecting pole 103*b*.

Figure 25:
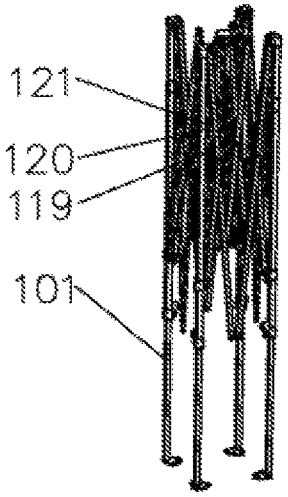
FIG. 25 is a schematic diagram illustrating the second exemplary water accumulation preventing pole group in FIG. 23 in a folded state.

The folding and unfolding method of the tent frame with the stepped metal sheet 121 is different from the sixth exemplary high-ceiling tent frame. With the stepped metal sheet 121, a rotating axis of relative rotation of the slidable connecting piece 120 and the stepped metal sheet 121 is staggered with a rotating axis of relative rotation of a fabric supporting pole 119 and the first connecting pole 103*b*. As a result, the fabric supporting pole 119 does not easily interfere with the first connecting pole 103*b*. In addition, the size is smaller when the tent frame is fully folded as shown in FIG. 25.

Figure 26:
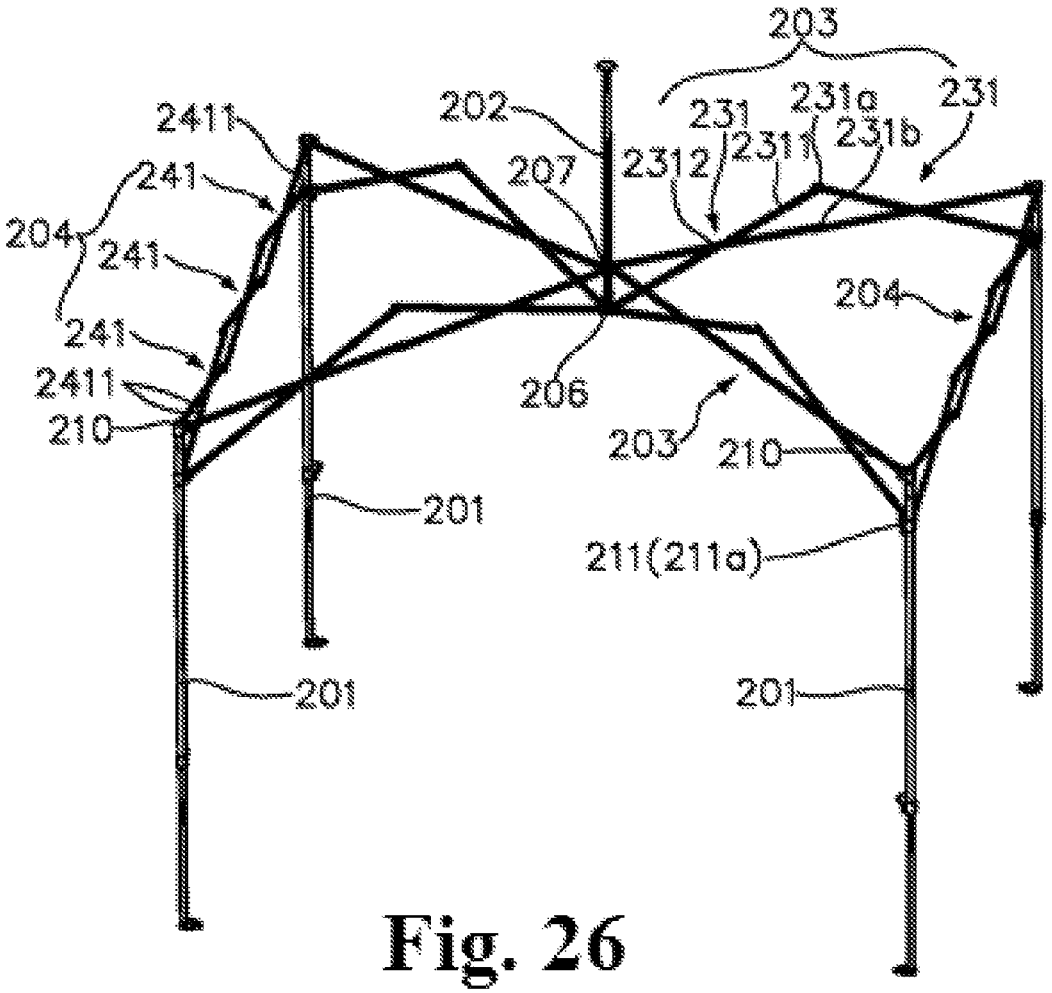
FIG. 26 is a schematic diagram illustrating an eighth exemplary high-ceiling tent frame according to some embodiments of the present invention.

Referring now to FIG. 26, there depicts an eighth exemplary high-ceiling tent frame according to some embodiments of the present invention. As shown in FIG. 26, in some embodiments, the eighth exemplary high-ceiling tent frame comprises a frame unit that comprises four vertical poles 201 and a center pole 202. Top ends of the vertical poles 201 and the center pole 202 are in direct contact with a tent fabric and support the tent fabric. It should be understood that the number of the vertical poles 201 can be three, five or more than five and can be selected according to the actual needs or personal preference. In a preferable embodiment, the vertical poles 201 are retractable poles. The four vertical poles 201 are divided into two vertical pole groups, each vertical pole group comprising two adjacent vertical poles 201. Side top pole group 204 is connected between the two vertical poles 201 of the same vertical pole group. A supporting top pole group 203 is connected between the center pole 202 and each vertical pole 201.

As shown in FIG. 26, when the tent frame is unfolded, the center pole 202 is placed vertically or substantially vertically at a top part of a tent. The center fixed connecting base 206 is installed at a bottom end of the center pole 202. The center slidable connecting base 207 which can slide on the center pole 202 is installed on a pole body of the center pole 202. A supporting piece used for supporting the tent fabric is installed at a top end of the center pole 202.

In some embodiments, the vertical poles 201 are placed vertically or substantially vertically after the tent frame is unfolded. In some embodiments, the vertical poles 201 are placed obliquely at a predetermined tilt angle relative to the ground according to the needs or personal preference. Vertical pole fixed connecting bases 210 are installed at top ends of the vertical poles 201. Vertical pole slidable connecting bases 211 which can slide along the vertical poles 201 are installed on pole bodies of the vertical poles 201. The vertical pole slidable connecting bases 211 are provided with stop devices 211*a* for preventing the vertical pole slidable connecting bases 211 from sliding downwards along the vertical poles 1 when the tent frame is unfolded. In some embodiments, the center slidable connecting base 207, the vertical pole fixed connecting bases 210, the vertical pole slidable connecting bases 211 and the stop devices 211*a* are parts similar to those in the art and thus are not described herein in details.

As shown in FIG. 26, in some embodiments, each supporting top pole group 203 comprises two first connecting pole units 231 which are pivotally connected to each other. Each first connecting pole unit 231 comprises two first connecting poles 2311 which are pivotally connected to each other and form an X-shape when unfolded. The two first connecting poles 2311 have a center hinging point 2312. The two first connecting pole units 231, which are pivotally connected to each other, have an upper hinging point 231*a* and a lower hinging point 231*b*. In some embodiments, an angle formed by the two first connecting poles 2311 at the upper hinging point 231*a* is smaller than an angle formed by the two first connecting poles 2311 at the lower hinging point 231*b*.

In each supporting top pole group 203, one first connecting pole 2311 of the first connecting pole unit 231 connected with the center pole 202 is pivotally connected to the center pole 202 through the center slidable connecting base 207. The other first connecting pole 2311 is pivotally connected to the center pole 202 through the center fixed connecting base 206. One first connecting pole 2311 of the first connecting pole unit 231 connected with the vertical poles 201 is pivotally connected to the vertical poles 201 through the vertical pole slidable connecting bases 211. The other first connecting pole 2311 is pivotally connected to the vertical poles 201 through the vertical pole fixed connecting bases 210.

Also as shown in FIG. 26, in some embodiments, each side top pole group 204 comprises three second connecting pole units 241 which are pivotally connected to each other. It should be understood that the number of the second connecting pole units 241 included in each side top pole group 204 can be one unit or a plurality of units, and the specific number can be determined according to the actual needs or preference. In some embodiments, each second connecting pole unit 241 comprises two second connecting poles 2411 which are pivotally connected to each other and form an X-shape when unfolded. Two second connecting poles 2411 of the second connecting pole units 241 at the two ends are respectively pivoted with the vertical fixed connecting bases 210 and the vertical pole slidable connecting bases 211 of the vertical poles 201.

To unfold the tent or tent frame, the vertical poles 201 are placed vertically or substantially vertically and are pulled open to predetermined positions. The vertical pole slidable connecting bases 211 are slid upwards to predetermined positions and are fixed on the vertical poles 201 by the stop devices 211*a*. Each first connecting pole 2311 of the supporting top pole group 203 is pulled open in a linked manner such that the two first connecting poles 2311 of each first connecting pole unit 231 form an X-shape. The two second connecting poles 2411 of the two second connecting pole units 241 of the side top pole group 204 also form an X-shape, and thus the unfolding of the tent frame can be realized. The tent fabric is placed on the tent frame, prior to or subsequent to the unfolding of the tent frame. The tent fabric is supported by supporting pieces and the top parts of the vertical poles 201.

To fold the tent or tent frame, the tent fabric is retrieved, the stop devices 211*a* are loosened, and the vertical poles 201 are retracted to a shorter or the shortest state. Then, the vertical pole slidable connecting bases 211 are slid downwards. The two first connecting poles 2311 of the first connecting pole units 231 of the supporting top pole group 203 are respectively clockwise and anticlockwise rotated. The four vertical poles 201 are driven to move towards the direction of the center pole 202. The two second connecting poles 2411 of the second connecting pole units 241 of the two side top pole groups 204 get close to each other. The center slidable connecting base 207 simultaneously slides upwards along the center pole 202 under the drive of the first connecting pole units 231. The center fixed connecting base 206 downwards moves together with the center pole 202 under the drive of the first connecting pole units 231. At the end, all poles are folded together.

As shown in FIG. 26, the eighth exemplary high-ceiling tent frame eliminates two side top pole groups (e.g., the front and back side in FIG. 26) and corresponding oblique supporting poles, reducing the size of the tent frame when folded and the manufacturing cost. In addition, on the sides without side top pole groups (e.g., the front and back side in FIG. 26), pits will not form during raining days and rain will fall down along the tent fabric and will not accumulate. As such, the tent frame reduces or prevents water accumulation and potential damage of the tent. In some embodiments, the side top pole group 204 adopts the second connecting pole units 241 which are pivotally connected to each other. The strength of the tent frame can be increased, and the side top pole groups on the other sides (e.g., the left and right side in FIG. 26) will not be ruptured if the water is accumulated. As such, the service life of the tent is prolonged, reducing the repairing or maintenance needs. In addition, the cross design reduces the folding height of the tent when folded.

Figure 27:
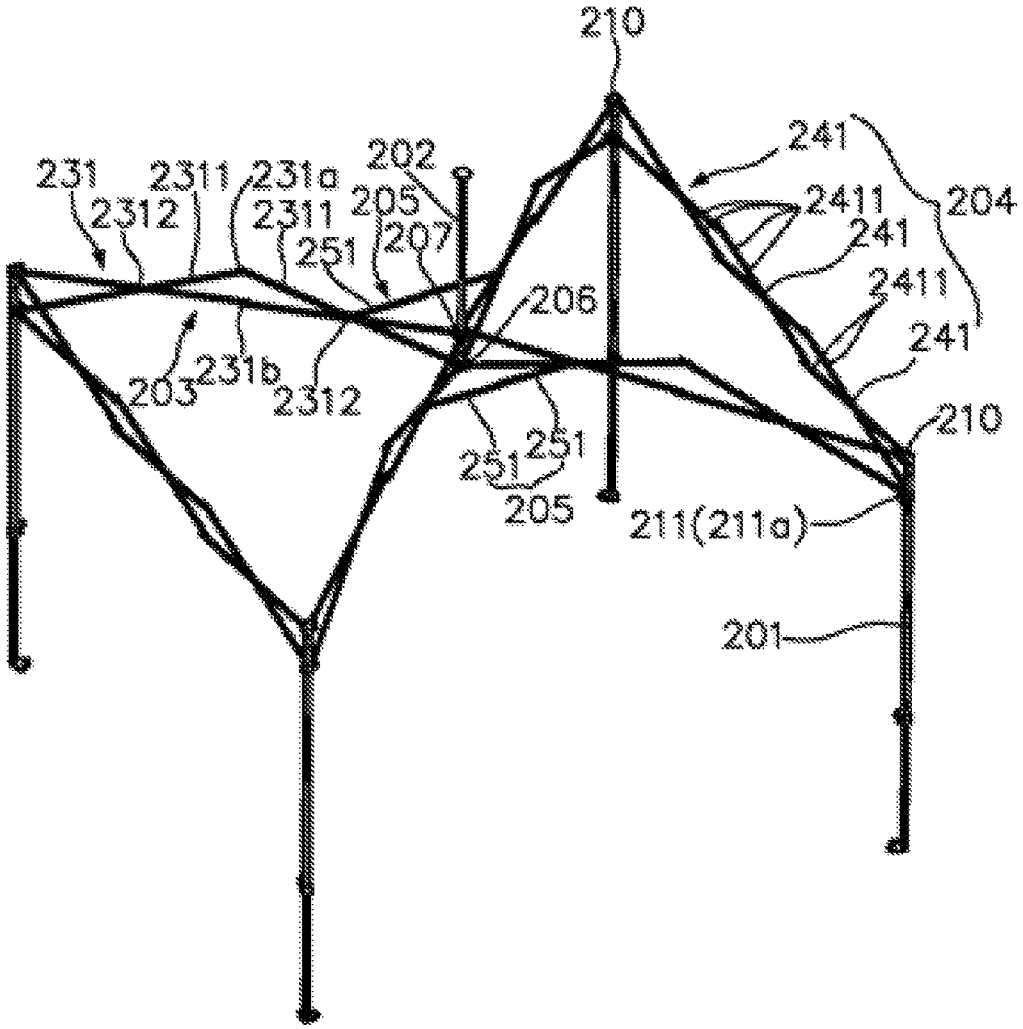
FIG. 27 is a schematic diagram illustrating a ninth exemplary high-ceiling tent frame according to some embodiments of the present invention.

FIG. 27 shows a ninth exemplary high-ceiling tent frame according to some embodiments of the present invention. The ninth exemplary high-ceiling tent frame is similar to the eighth exemplary high-ceiling tent frame, except inner horizontal pole groups 205 are connected between two supporting top pole groups 203 connected onto different vertical pole groups in the same frame unit. In some embodiments, each inner horizontal pole group 205 comprises two short poles 251 which are pivotally connected to each other at one ends of the two short poles 251. The other ends of the two short poles 251 are respectively and pivotally connected to center hinging points 2312, close to the center pole 202, of the supporting top pole group 203. The inner horizontal pole groups 205 increase the overall supporting strength of the tent frame, enlarge the internal space of the tent frame and make the top part or ceiling of the assembled tent frame more stable and robust.

Methods or processes for folding and unfolding the ninth exemplary high-ceiling tent frame are similar to those disclosed herein. In folding, when all poles get close to the center pole 202, the two short poles 251 of each inner horizontal pole group 205 will act accordingly. Thus, the two short poles 251 are rotated to get close to each other, completing the folding of the tent frame.

Figure 28:
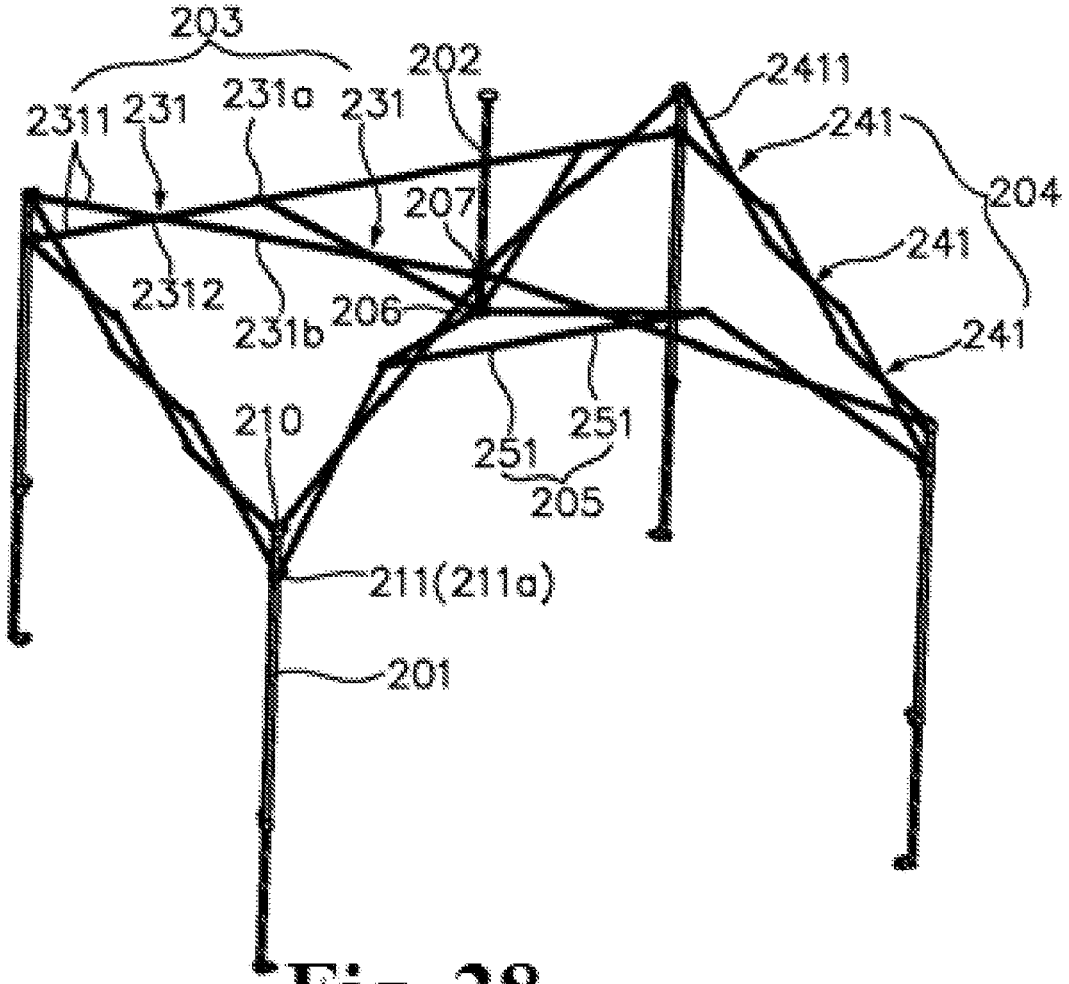
FIG. 28 is a schematic diagram illustrating a tenth exemplary high-ceiling tent frame according to some embodiments of the present invention.

FIG. 28 shows a tenth exemplary high-ceiling tent frame according to some embodiments of the present invention. The tenth exemplary high-ceiling tent frame is similar to the eighth exemplary high-ceiling tent frame, except inner horizontal pole groups 205 are connected between two supporting top pole groups 203 connected onto different vertical pole groups in the same frame unit. In some embodiments, each inner horizontal pole group 205 comprises two short poles 251 which are pivotally connected to each other at one ends of the two short poles 251. The other ends of the two short poles 251 are respectively pivoted with upper hinging points 231*a* of the two first connecting units 231, which are pivotally connected to each other, of two supporting top pole groups 203. The inner horizontal pole groups 205 increase the overall supporting strength of the tent frame, enlarge the internal space of the tent and make the top part or ceiling of the assembled tent frame more stable and robust.

Figure 29:
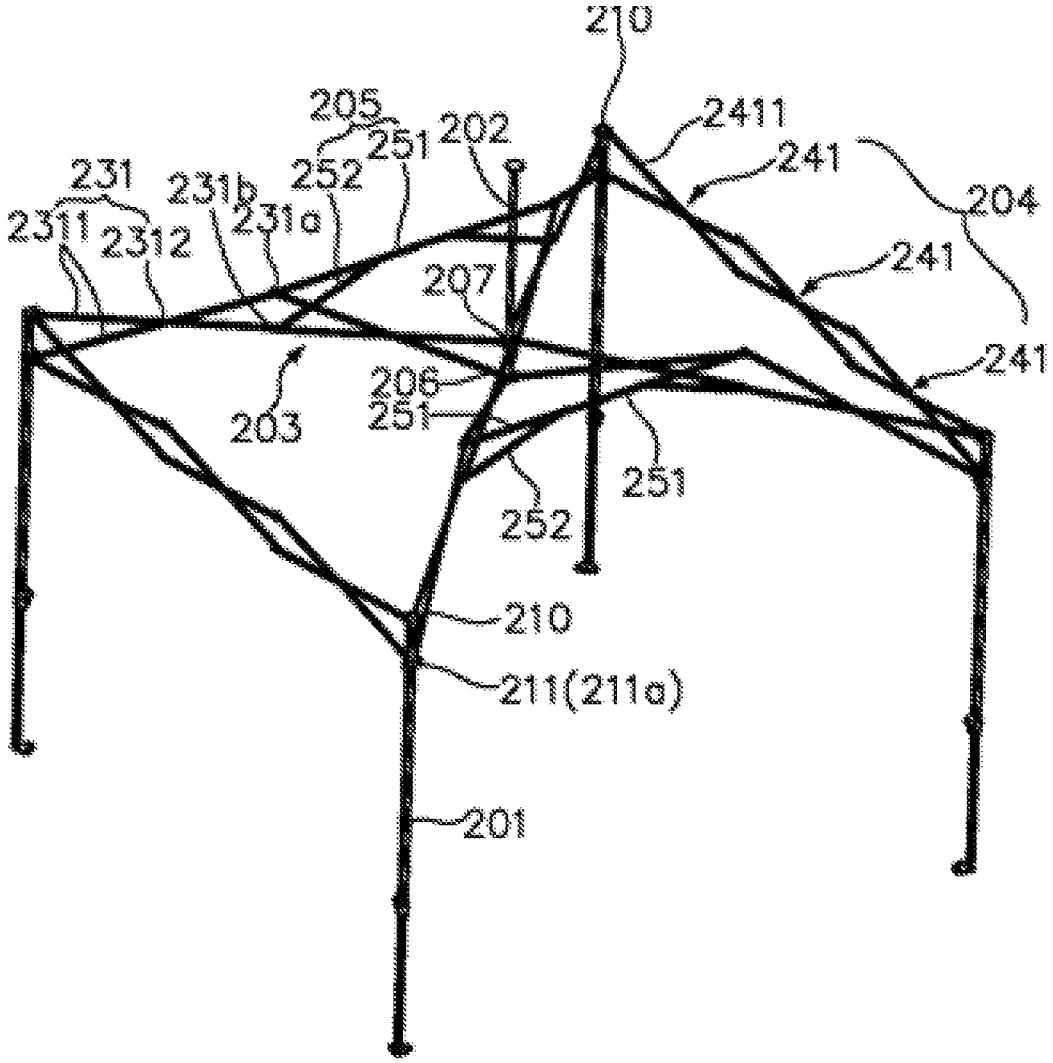
FIG. 29 is a schematic diagram illustrating an eleventh exemplary high-ceiling tent frame according to some embodiments of the present invention.

FIG. 29 shows an eleventh exemplary high-ceiling tent frame according to some embodiments of the present invention. The eleventh exemplary high-ceiling tent frame is similar to the eighth exemplary high-ceiling tent frame, except inner horizontal pole groups 205 are connected between two supporting top pole groups 203 connected onto different vertical pole groups in the same frame unit. In some embodiments, each inner horizontal pole group 205 comprises two short poles 251 which are pivotally connected to each other at one ends of the two short poles 251. The other ends of the two short poles 251 are respectively pivotally connected to upper hinging points 231*a* of the two first connecting units 231, which are pivotally connected to each other, of the corresponding supporting top pole groups 203.

In addition, in the eleventh exemplary high-ceiling tent frame, an additional or optional oblique supporting pole 252 is pivotally connected to each short pole 251. One end of the oblique supporting pole 252 is pivotally connected to a pole body of the short pole 251 and the other end is pivotally connected to a lower hinging point 231*b* of the first connecting pole unit 231 pivotally connected to the corresponding short pole 251. The inner horizontal pole groups 205 increase the overall supporting strength of the tent frame, enlarge the internal space of the tent and make the top part or ceiling of the assembled tent frame more stable and robust.

Figure 30:
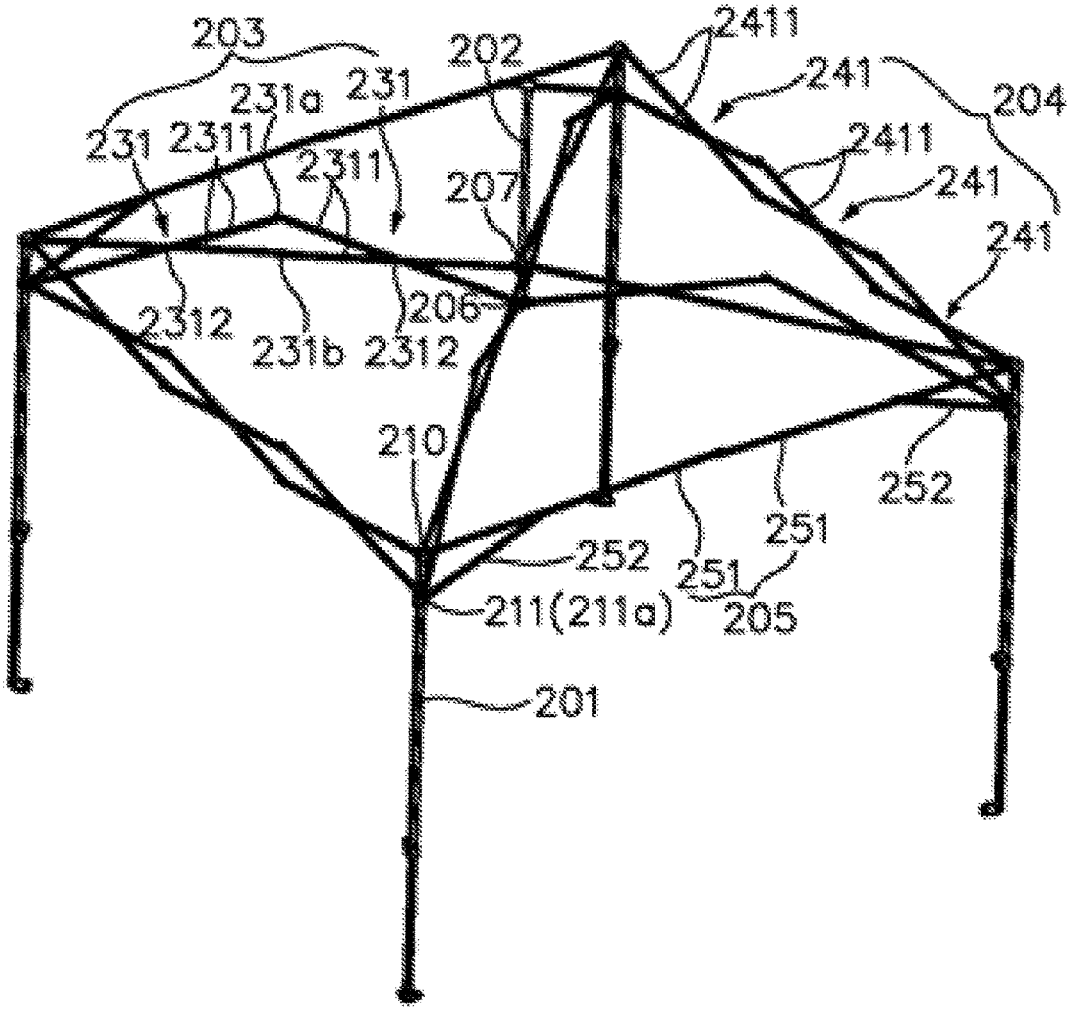
FIG. 30 is a schematic diagram illustrating a twelfth exemplary high-ceiling tent frame according to some embodiments of the present invention.

FIG. 30 shows a twelfth exemplary high-ceiling tent frame according to some embodiments of the present invention. The twelfth exemplary high-ceiling tent frame is similar to the eighth exemplary high-ceiling tent frame, except inner horizontal pole groups 205 are connected between two supporting top pole groups 203 connected onto different vertical pole groups in the same frame unit. In some embodiments, each inner horizontal pole group 205 comprises two short poles 251 which are pivotally connected to each other at one ends of the two short poles 251. The other ends of the two short poles 251 are respectively pivotally connected to corresponding vertical poles 201 through corresponding vertical pole fixed connecting bases 210.

In addition, in the twelfth exemplary high-ceiling tent frame, an additional or optional oblique supporting pole 252 is pivotally connected to each short pole 251. One end of the oblique supporting pole 252 is pivotally connected to a pole body of the short pole 251 and the other end is pivotally connected to the vertical pole slidable connecting base 211 of the vertical pole 201 pivotally connected to the corresponding short pole 251. The inner horizontal pole groups 205 increase the overall supporting strength of the tent frame, enlarge the internal space of the tent and make the top part or ceiling of the assembled tent frame more stable and robust.

Figure 31:
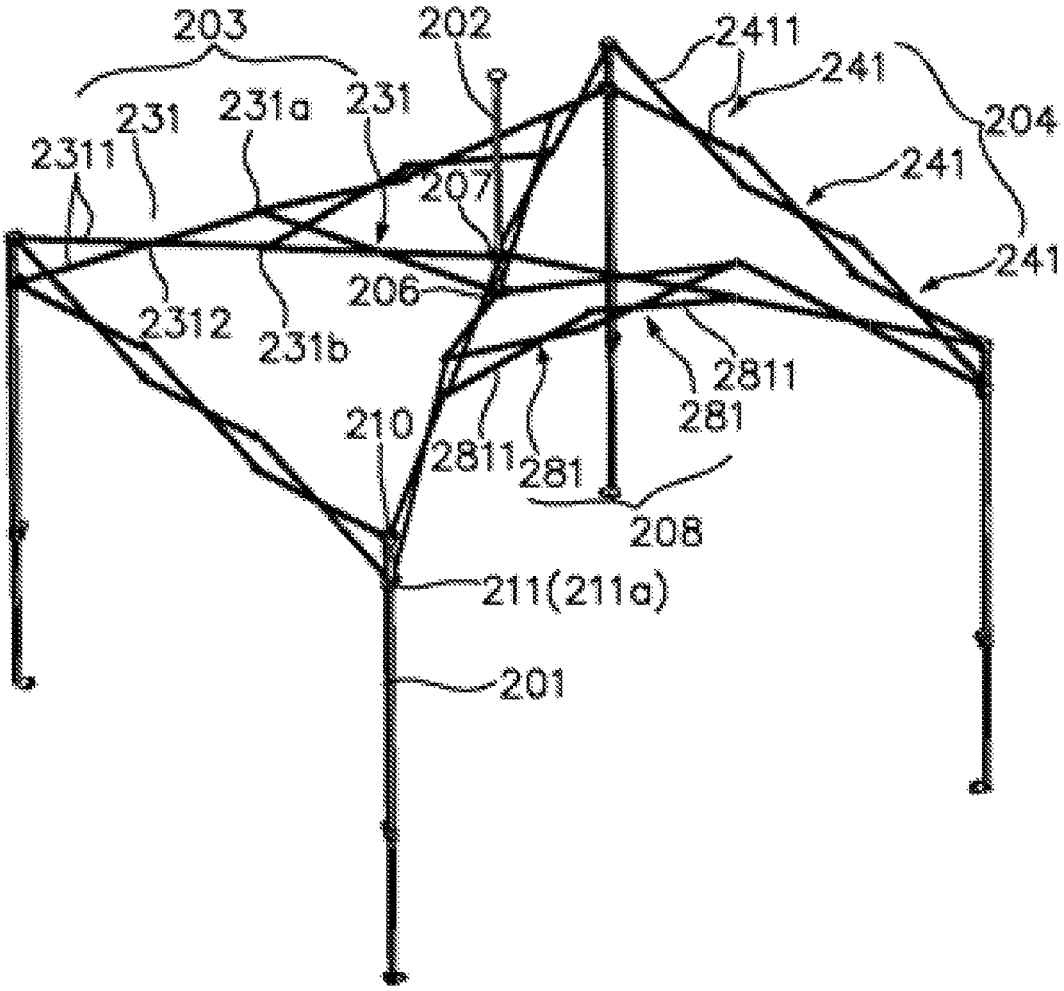
FIG. 31 is a schematic diagram illustrating a thirteenth exemplary high-ceiling tent frame according to some embodiments of the present invention.

FIG. 31 shows a thirteenth exemplary high-ceiling tent frame according to some embodiments of the present invention. The thirteenth exemplary high-ceiling tent frame is similar to the eighth exemplary high-ceiling tent frame, except inner horizontal pole groups 208 are connected between two supporting top pole groups 203 connected onto different vertical pole groups in the same frame unit. In some embodiments, each inner horizontal pole group 208 comprises one or more third connecting pole units 281 which are pivotally connected to each other. By way of illustration, FIG. 31 shows that each inner horizontal pole group 208 comprises two third connecting pole units 281. Each third connecting pole unit 281 comprises two third connecting poles 2811 which are pivotally connected to each other and form an X-shape when unfolded.

In some embodiments, one third connecting pole 2811 in the third connecting pole unit 281 connected with the supporting top pole group 203 is pivotally connected to an upper hinging point 231*a* of the first connecting pole units 231, which are pivotally connected to each other, of the supporting top pole group 203. The other third connecting pole 2811 is pivotally connected to a lower hinging point 231*b* of the first connecting pole units 231, which are pivotally connected to each other, of the supporting top pole group 203. The inner horizontal pole groups 208 increase the overall supporting strength of the tent frame, enlarge the internal space of the tent and make the top part or ceiling of the assembled tent frame more stable and robust.

It should be understood that fine structural adjustment may be needed to parts such as the center fixed connecting base 7, the center slidable connecting base 8, the supporting pieces 9, the bottom foot pieces 10, the vertical pole fixed connecting bases 11, the vertical pole slidable connecting bases 12 and the stop devices 12*a* in each above-mentioned embodiment according to the specific structure of the tent frame in each embodiment. These parts can be the same as or similar to those in the art. Adaptive modification can be made according to the actual needs based on the existing parts.

For convenience in explanation and accurate definition in the appended claims, the terms "top" or "bottom", "upper" or "lower", "vertical" or "horizontal", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings, for example, changing the retractable vertical poles 2 to foldable two-section vertical poles, or disassembling and recombining the parts of each embodiment. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tent frame, comprising:

one or more frame units, each frame unit comprising:

three or more vertical poles;

a center pole;

a plurality of supporting pole groups for connecting the center pole with the vertical poles;

vertical pole fixed connecting bases installed at top ends of the vertical poles;

vertical pole slidable connecting bases installed on pole bodies of the vertical poles and slidable along the pole bodies of the vertical poles;

a center fixed connecting base installed at a bottom end of the center pole;

a center slidable connecting base installed on a pole body of the center pole and slidable along the pole body of the center pole; and a connecting pin and a spring disposed between the center pole and the center fixed connecting base, wherein:

each supporting pole group comprises first connecting pole units;

the first connecting pole units are pivotally connected to each other;

each first connecting pole unit comprises two first connecting poles pivotally connected to each other and forms an X-shape when the tent frame is unfolded;

in each supporting top pole group, the first connecting pole unit adjacent the center pole has one of the two first connecting poles pivotally connected to the center slidable connecting base and the other one of the two first connecting poles pivotally connected to the center fixed connecting base, and the first connecting pole unit adjacent a corresponding vertical pole has one of the two first connecting poles pivotally connected to the vertical pole slidable connecting base and the other one of the two first connecting poles pivotally connected to the vertical pole fixed connecting base of the corresponding vertical pole;

a first elongated slot or a first pin hole is formed at a bottom end portion of the center pole;

the center fixed connecting base includes: (i) a connecting pole hinging part for receiving the other first connecting poles, (ii) a blind hole for receiving the center pole, (iii) a second pin hole corresponding to the first elongated slot of the center pole and formed adjacent to a mouth part of the blind hole, or a second elongated slot corresponding to the first pin hole of the center pole and formed on a side wall of the blind hole;

the connecting pin penetrates through the corresponding elongated slot and the corresponding pin hole, connecting the center pole with the center fixed connecting base; and the spring is placed in the blind hole, one end of the spring presses against a bottom end of the center pole and the other end presses against a bottom part of the blind hole.

2. The high ceiling tent frame according to claim 1, further comprising:

side top pole groups each configured to connect two adjacent vertical poles; and oblique supporting poles each configured to connect a side top pole group to a corresponding vertical pole.

3. The tent frame according to claim 2, wherein:

each side top pole group comprises two side top poles pivotally connected to each other and forms a substantially straight line when the tent frame is unfolded;

one end of each side top pole is pivotally connected to the vertical pole fixed connecting base of a corresponding vertical pole in the two adjacent vertical poles;

one end of each oblique supporting pole is pivotally connected to the vertical pole slidable connecting base of the corresponding vertical pole; and the other end of each oblique supporting pole is pivotally connected to the side top pole that is connected to the same corresponding vertical pole.

4. The tent frame according to claim 1, wherein within a respective frame unit:

the three or more vertical poles comprises four vertical poles that form two vertical pole groups, wherein each vertical pole group comprises two adjacent vertical poles;

the two adjacent vertical poles in each vertical pole group are connected by a side top pole group;

the side top pole group comprises second connecting pole units;

the second connecting pole units are pivotally connected to each other;

each second connecting pole unit comprises two second connecting poles pivotally connected to each other and forms an X-shape when the tent frame is unfolded;

one of the second connecting poles of each second connecting pole unit adjacent the corresponding vertical pole is pivotally connected to the vertical pole slidable connecting base of the corresponding vertical pole; and the other one of the second connecting poles of each second connecting pole unit adjacent the corresponding vertical pole is pivotally connected to the vertical pole fixed connecting base of the corresponding vertical pole.

5. The tent frame according to claim 4, further comprising:

an inner horizontal pole group for connecting two of the supporting top pole groups that are connected to different vertical pole groups within the respective frame unit, wherein the inner horizontal pole group comprises one of the following:

two short poles, one ends thereof are pivotally connected to each other, and the other ends thereof are pivotally connected to the first connecting pole units of the supporting top pole groups at hinging points adjacent to the center pole;

two short poles, one ends thereof are pivotally connected to each other, and the other ends are pivotally connected to the first connecting pole units of the corresponding supporting top pole group at upper hinging points of the first connecting pole units;

two short poles, one ends thereof are pivotally connected to each other, and the other ends are pivotally connected to the first connecting pole units of the corresponding supporting top pole group at the upper hinging points of the first connecting pole units, wherein each short pole is supported by an oblique supporting pole, wherein one end of the oblique supporting pole is pivotally connected to a pole body of the corresponding short pole and the other end is pivotally connected to a lower hinging point of a corresponding first connecting pole unit; or third connecting pole units, wherein the third connecting pole units are pivotally connected to each other, each third connecting pole unit comprises two third connecting poles pivotally connected to each other and forms an X-shape when the tent frame is unfolded, one of the two third connecting poles of each third connecting pole unit adjacent the corresponding supporting top pole group is pivotally connected to a first connecting pole unit of the corresponding supporting top pole group at the upper hinging point of the first connecting pole unit and the other one of the two third connecting poles of the third connecting pole unit adjacent the corresponding supporting top pole group is pivotally connected to the first connecting pole unit of the corresponding supporting top pole group at the lower hinging point of the first connecting pole unit.

6. The tent frame according to claim 4, further comprising:

an inner horizontal pole group for connecting two adjacent vertical poles in the two vertical pole groups within the respective frame unit, wherein the inner horizontal pole group comprises two short poles, one ends thereof are pivotally connected to each other, and the other ends are pivotally connected to the vertical pole fixed connecting bases of the corresponding vertical poles; and each short pole is supported by an oblique supporting pole, wherein one end of the oblique supporting pole is pivotally connected to a pole body of the corresponding short pole and the other end is pivotally connected to the vertical pole slidable connecting base of a corresponding vertical pole.

7. The tent frame according to claim 1, further comprising:

supporting pieces installed on the first connecting poles that are connected to the vertical pole fixed connecting bases, wherein each supporting piece comprises:

a connecting part fixedly connected to a corresponding first connecting pole; and a horizontal pole for supporting a tent fabric, wherein the horizontal pole and the connecting part are fixedly connected to each other at a predetermined angle.

8. The tent frame according to claim 1, further comprising:

one or more water accumulation preventing pole groups, wherein a water accumulation preventing pole group is connected to a corresponding first connecting pole unit and comprises:

a slidable connecting piece pivotally connected to one first connecting pole of the corresponding first connecting pole unit; and a fabric supporting pole, a pole body thereof slidably connected to the slidable connecting piece and one end thereof pivotally connected to the other first connecting pole of the corresponding first connecting pole unit, such that the fabric supporting pole is disposed substantially vertically and upwardly when the tent frame is unfolded.

9. The tent frame according to claim 8, wherein the slidable connecting piece is pivotally connected to the one first connecting pole of the corresponding first connecting pole unit by a bracket, wherein the bracket is pivotally connected to the slidable connecting piece and fixedly connected to the first one connecting pole of the corresponding first connecting pole unit.

10. The tent frame according to claim 1, wherein the one or more frame units comprise at least two frame units, wherein two adjacent frame units are connected to each other by sharing at least two vertical poles.

11. The tent frame according to claim 1, further comprising:

one or more water accumulation preventing pole groups, wherein a water accumulation preventing pole group in the one or more water accumulation preventing pole groups comprises:

an eave supporting pole;

an eave moving pole, one end thereof pivotally connected to one end of the eave supporting pole, and the other end or a pole body of the eave moving pole pivotally connected to the one or the other one of the two first connecting poles of the first connecting pole unit adjacent the corresponding vertical pole; and a connecting part, one end thereof pivotally connected to the pole body of the eave pole and the other end thereof pivotally connected to one of the first connecting poles of the first connecting pole unit adjacent the corresponding vertical pole.

12. A tent frame, comprising:

one or more frame units, each frame unit comprising:

three or more vertical poles;

a center pole;

a plurality of supporting pole groups for connecting the center pole with the vertical poles;

vertical pole fixed connecting bases installed at top ends of the vertical poles;

vertical pole slidable connecting bases installed on pole bodies of the vertical poles and slidable along the pole bodies of the vertical poles;

a center fixed connecting base installed at a bottom end of the center pole;

a center slidable connecting base installed on a pole body of the center pole and slidable along the pole body of the center pole; and one or more water accumulation preventing pole groups, wherein:

each supporting pole group comprises first connecting pole units;

the first connecting pole units are pivotally connected to each other;

each first connecting pole unit comprises two first connecting poles pivotally connected to each other and forms an X-shape when the tent frame is unfolded;

in each supporting pole group, the first connecting pole unit adjacent the center pole has one of the two first connecting poles pivotally connected to the center slidable connecting base and the other one of the two first connecting poles pivotally connected to the center fixed connecting base, and the first connecting pole unit adjacent a corresponding vertical pole has one of the two first connecting poles pivotally connected to the vertical pole slidable connecting base and the other one of the two first connecting poles pivotally connected to the vertical pole fixed connecting base of the corresponding vertical pole; and a water accumulation preventing pole group in the one or more water accumulation preventing pole groups comprises:

an eave supporting pole;

an eave moving pole, one end thereof pivotally connected to one end of the eave supporting pole, and the other end or a pole body of the eave moving pole pivotally connected to the one or the other one of the two first connecting poles of the first connecting pole unit adjacent the corresponding vertical pole; and a connecting part, one end thereof pivotally connected to the pole body of the eave pole and the other end thereof pivotally connected to one of the first connecting poles of the first connecting pole unit adjacent the corresponding vertical pole.

13. The tent frame according to claim 12, wherein the eave moving pole comprises:

a first pole;

a second pole, one end thereof rotatably connected to one end of the first pole; and a stop block disposed at the connected ends of the first pole and the second pole and configured to limit a rotating angle of the first and second poles.

14. The tent frame according to claim 12, wherein the vertical poles, the eave pole or both the vertical poles and the eave pole are retractable poles.

15. The tent frame according to claim 12, wherein the one or more frame units comprise at least two frame units, wherein two adjacent frame units are connected to each other by sharing at least two vertical poles.

* * * * *